US009611079B2

(12) United States Patent
Mazurkiewicz et al.

(10) Patent No.: US 9,611,079 B2
(45) Date of Patent: Apr. 4, 2017

(54) FITMENT AND OVERCAP THEREFOR

(71) Applicant: AptarGroup, Inc., Crystal Lake, IL (US)

(72) Inventors: Timothy Mazurkiewicz, Waukesha, WI (US); John Wisniewski, Wauwatosa, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 14/764,089

(22) PCT Filed: Mar. 5, 2015

(86) PCT No.: PCT/US2015/018864
§ 371 (c)(1),
(2) Date: Jul. 28, 2015

(87) PCT Pub. No.: WO2016/140668
PCT Pub. Date: Sep. 9, 2016

(65) Prior Publication Data

US 2016/0272380 A1 Sep. 22, 2016

(51) Int. Cl.
*B65D 39/16* (2006.01)
*B65D 47/12* (2006.01)
(Continued)

(52) U.S. Cl.
CPC ..... *B65D 47/123* (2013.01); *B65D 41/0485* (2013.01); *B65D 41/34* (2013.01); *B65D 75/5883* (2013.01); *B65D 2101/0023* (2013.01)

(58) Field of Classification Search
CPC ..... B65D 47/123; B65D 75/5883; B65D 2101/0023; B65D 41/0485; B65D 41/34
(Continued)

(56) References Cited

U.S. PATENT DOCUMENTS 1,898,342 A 2/1933 Cuthbert
2,374,143 A 4/1945 Stevenson
(Continued)

FOREIGN PATENT DOCUMENTS

CA 1038806 A1 9/1978
CA 1074732 A1 4/1980
(Continued)

OTHER PUBLICATIONS

The "International Search Report and the Written Opinion of the International Searching Authority, or the Declaration" dated "Jun. 8, 2015" for the International Application No. PCT/US2015/018864 of which the above-captioned instant U.S. Appl. No. (not yet designated) is a U.S. national phase application.

*Primary Examiner* — J. Gregory Pickett
*Assistant Examiner* — Niki M Eloshway
(74) *Attorney, Agent, or Firm* — Wood, Phillips, Katz, Clark & Mortimer

(57) ABSTRACT

A closure assembly (20) that includes a cap or overcap (28) and a fitment (24) for a container is provided wherein the fitment (24) has a laterally projecting shear member (40), and the overcap (28) has an aperture (74) for initially receiving the shear member (40) when the overcap (28) and fitment (24) are in an initially assembled orientation or condition. The aperture (74) and the shear member (40) cooperate in the initially assembled orientation such that when subjected to a flow of a sterilizing gas, turbulence is created in the sterilizing gas flow to enhance sterilization of the combination. The closure assembly (20) may, instead, or additionally, be provided wherein the overcap (28) has an elongate, hollow plug (58) for establishing a first seal between the fitment (24) and the overcap (28) in the initially assembled orientation, and the wherein overcap (28) has a skirt (50) for establishing a second seal between the fitment
(Continued)

(24) and the overcap (28) in the initially assembled orientation.

3 Claims, 18 Drawing Sheets

(51) Int. Cl.
*B65D 75/58* (2006.01)
*B65D 41/04* (2006.01)
*B65D 41/34* (2006.01)
*B65D 39/08* (2006.01)

(58) Field of Classification Search
USPC ..... 215/251, 252, 257, 330, 331
See application file for complete search history.

(56) References Cited

U.S. PATENT DOCUMENTS 2,582,721 A 1/1952 Roshkind
3,540,612 A 11/1970 Brady
3,581,927 A 6/1971 Langdon
4,057,160 A 11/1977 Victor et al.
4,299,330 A 11/1981 Walter
4,583,652 A 4/1986 Goldberg
4,609,115 A 9/1986 Moore et al.
4,712,699 A 12/1987 Lutz
4,896,783 A * 1/1990 Leoncavallo ..... B01D 29/05 215/330
4,946,055 A 8/1990 Towns et al.
5,046,630 A 9/1991 Schneider et al.
5,105,961 A 4/1992 Noren et al.
5,552,117 A 9/1996 Burns
5,630,522 A 5/1997 Montgomery
5,692,628 A 12/1997 Montgomery et al.
5,699,924 A * 12/1997 Mascio ..... B65D 41/3447 215/252
5,720,402 A 2/1998 May
5,819,965 A 10/1998 King et al.
5,954,215 A 9/1999 Alter
6,041,953 A 3/2000 Goodall
6,105,802 A 8/2000 French et al.
6,477,743 B1 11/2002 Gross et al.
6,622,882 B2 9/2003 Smith
6,779,672 B2 8/2004 Kano et al.
6,971,550 B2 12/2005 Kuge et al.
7,097,058 B2 8/2006 Wellman et al.
7,677,422 B2 3/2010 Lee
7,743,952 B2 6/2010 Auer et al.
7,980,403 B2 7/2011 Martinez
2002/0130101 A1 9/2002 Ekkert
2004/0055990 A1* 3/2004 Dubach ..... B65D 41/3409 215/252
2004/0245204 A1* 12/2004 Suffa ..... B65D 41/0471 215/224
2004/0251228 A1 12/2004 Long
2005/0199573 A1* 9/2005 Last ..... B65D 41/3423 215/252
2005/0284836 A1 12/2005 Majoor et al.
2006/0207960 A1* 9/2006 Bastero Lopez .. B65D 41/3409 215/331
2007/0175853 A1 8/2007 Kebben
2010/0230375 A1* 9/2010 Gruenwald ..... B65D 51/28 215/228
2011/0024383 A1 2/2011 Mckenna et al.
2013/0175285 A1 7/2013 Elliot et al.

FOREIGN PATENT DOCUMENTS

CA 1114781 A1 12/1981
CA 1192526 A1 8/1985
CA 1196606 A1 11/1985
CA 2014709 A1 5/1991
CA 2153533 A1 2/1996
CA 2248589 A1 3/2000
CA 2412366 A1 12/2002
CA 2469654 A1 6/2004
CA 2212291 C 5/2005
CA 2286584 C 8/2006
CA 2459477 C 8/2007
CA 2648546 A1 10/2008
CA 2478524 C 12/2008
CA 2677155 A1 7/2009
CA 2718060 A1 9/2009
CA 2727261 A1 1/2010
CA 2750878 A1 8/2010
CA 2785730 A1 7/2011
WO 9215496 A1 9/1992
WO 03068622 A1 8/2003
WO 2004035410 A1 4/2004
WO 2004045977 A1 6/2004
WO 2005032964 A2 4/2005
WO 2005037524 A2 4/2005
WO 2005115859 A1 12/2005
WO 2008048406 A2 4/2008
WO 2013040621 A1 3/2013
WO 2013103946 A1 7/2013
WO 2013119781 A1 8/2013
WO 2013147599 10/2013
WO 2013181491 12/2013
WO 2015065481 A1 5/2015

* cited by examiner

FITMENT AND OVERCAP THEREFOR

CROSS-REFERENCE TO RELATED APPLICATION(S)

Not Applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a closure assembly that can be installed on a containment system (e.g., a container such as a pouch, carton, etc.) to provide (1) a spout extending from the containment system, and (2) a removable overcap therefor. The invention is particularly suitable for use with a handheld pouch containing a fluid product (e.g., a drink product, baby formula, yogurt, food additive, pharmaceutical product, etc.) wherein the closure assembly is initially provided to a packager for sterilization with a sterilizing gas so as to create an aseptic closure assembly that the packager can then install on the pouch.

BACKGROUND OF THE INVENTION AND TECHNICAL PROBLEMS POSED BY THE PRIOR ART

Various types of packages, including those that employ a flexible, collapsible, pouch-type container (i.e., a pouch), are used for holding and dispensing a product, especially a fluid product. Such packages, including packages employing a pouch-type container, typically include a removable cover, cap, or overcap to initially prevent ingress of contaminants. More particularly, the package may include a closure assembly that has a projecting neck or spout through which the product can be poured, imbibed, or otherwise removed, and on which the overcap is initially installed. A pouch or carton type package typically has a closure assembly that includes a fitment for being sealed to the pouch or carton wall, and the fitment has an outwardly projecting spout through which the pouch contents can be discharged and which is adapted to receive a removable overcap for initially closing the spout. The fitment typically has an exterior male thread on the spout for cooperating with a female thread on the inside of the overcap.

Typically, the fitment and overcap are initially made separately by a manufacturer who can provide them to a packager or filler either as separate components or screwed together to create a closed closure assembly. The separate components or the completed closure assembly are subsequently provided to a packager or filler for completing the manufacture of the package.

In one method for making a flexible, collapsible, pouch-type package, the pouch is initially formed with an open top end, and while empty, is sealed at its open top end to the fitment component of the closure assembly prior to installation of the overcap. Subsequently, the pouch can be filled with product through the fitment open spout, and then the overcap can be installed in a closed condition on the fitment spout.

In an alternate method for making a pouch-type package—which is preferred when at least the closure assembly is to be sterilized (or otherwise cleaned)—the packager or filler employs a "form, fill, and seal" operation to first form the pouch with an open top end, then fill the pouch with product through the pouch open top end, then insert the closed closure assembly in the pouch open top end, and lastly seal the top end of the pouch around the closed closure assembly.

In some cases, a packager or filler may what to sterilize or otherwise clean the closure assembly before installing the closure assembly on the container. Some packagers or fillers typically clean or sterilize the packaging components (including a closed closure assembly) in a cleaning chamber (which may be, or may include, a sterilizing chamber) wherein a cleaning gas or sterilizing gas (e.g., hydrogen peroxide gas) flows through the chamber in contact with the packaging component or components.

The inventors of the present invention have observed that a closed closure assembly (comprising a fitment with a projecting threaded spout having a threaded overcap initially mounted thereon) can be difficult to clean and/or sterilize in a cleaning system, including a hydrogen peroxide gas sterilizing system. The inventors of the present invention have determined that it would be desirable to provide an improved spout and overcap configuration for facilitating such cleaning.

The inventors of the present invention have further determined that it would be advantageous to provide an assembly of a fitment with a projecting spout and a mating overcap that together would readily accommodate cleaning, especially hydrogen peroxide gas sterilization, in a way that would result in enhanced cleaning or sterilization of the assembly—preferably a level of cleaning or sterilization sufficient to receive approval of a government body (e.g., the United States of America federal Food and Drug Administration ("FDA")) for use with food or pharmaceutical products.

Closure assembly components are typically molded from polyethylene or polypropylene. Such a closure assembly can be installed by heat sealing the assembly to a polyethylene or polypropylene laminate layer of the pouch walls. Typically, the pouch also includes a laminate layer of metal foil which reduces the permeation or transmission of atmospheric oxygen (or other gases) through the pouch wall so as to minimize or reduce adverse effects of the oxygen (or other gases) on the product in the pouch. Such adverse effects depend on the nature of the product, and can include undesirable changes in the product color, for example, or other characteristics.

Over time, oxygen (and/or other gases) can also pass from the external, ambient atmosphere through the wall of a closure spout and/or through the wall of a closure overcap, and then ultimately adversely affect a product in the package. The inventors of the present invention have observed that a closure assembly having a relatively long neck or spout would present an undesirably large wall area through which oxygen (or other gases) could pass and possibly adversely affect the product in the package.

The inventors of the present invention have also determined that it would be desirable to provide a spout with a length sufficient to readily accommodate a person's mouth, including lips, during drinking from the container spout. Additionally, the inventors of the present invention have determined that it would be especially advantageous to provide a fitment spout and mating overeat with a structure that would minimize, or at least reduce, the portions of the spout and overcap that are in communication with the product so as to minimize, or at least reduce, the permeation of oxygen (and/or other gases) which, over time, could have an adverse effect on the product contained within the package.

The inventors of the present invention have also discovered that it would be desirable to provide an improved spout and overcap that has been configured so as to exhibit one or more of the following attributes, features, or advantages:

A. component configurations that can be manufactured and/or assembled without excessive difficulty or excessively complicated operations, and B. component configurations that can be manufactured and/or assembled without excessive cost.

BRIEF SUMMARY OF THE INVENTION

The present invention provides a closure assembly comprising an overcap and a fitment for a container, which together in an initially assembled orientation prevent, but can be subsequently operated to permit, communication through the fitment.

According to one general aspect of the invention, the fitment includes a spout that defines an access passage, an exterior sealing surface, and at least one laterally projecting shear member. The cap defines a skirt that extends over a portion of the spout. The skirt has a skirt sealing surface for engaging the fitment exterior sealing surface to create a seal when the cap and the fitment are in the initially assembled orientation. The cap further defines an aperture for initially receiving the shear member when the cap and fitment are in the initially assembled orientation. The cap also defines at least one frangible bridge that extends across a portion of the aperture for being severed by the shear member during relative rotation between the cap and fitment. The aperture and the shear member cooperate, when the cap and the fitment are in the initially assembled orientation and subjected to a flow of a sterilizing gas, to create turbulence in the sterilizing gas flow adjacent portions of the cap and the fitment to enhance sterilization thereof.

Another aspect of the present invention also includes a closure assembly comprising a cap and a fitment for a container, which together in an initially assembled orientation prevent, but can be subsequently operated to permit, communication through the fitment. According to this other aspect of the invention, the fitment has a spout that defines an access passage, an interior sealing surface, and an exterior sealing surface. The cap has a top deck from which extends an elongate, hollow plug. The elongate, hollow plug has a plug sealing surface for engaging the fitment interior sealing surface to create a first seal when the cap and the fitment are in the initially assembled orientation. The cap also has a skirt extending over at least a portion of the spout, and has a skirt sealing surface for engaging the fitment exterior sealing surface to create a second seal when the cap and the fitment are in the initially assembled orientation. The cap also has an annular channel, that is defined between the elongate, hollow plug and the skirt, into which the fitment spout extends to accommodate relative rotation between the cap and the fitment.

It should be appreciated that forms of the invention may include only some of the above-described features, or include any combination of the above-described features. Furthermore, other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

Figure 1:
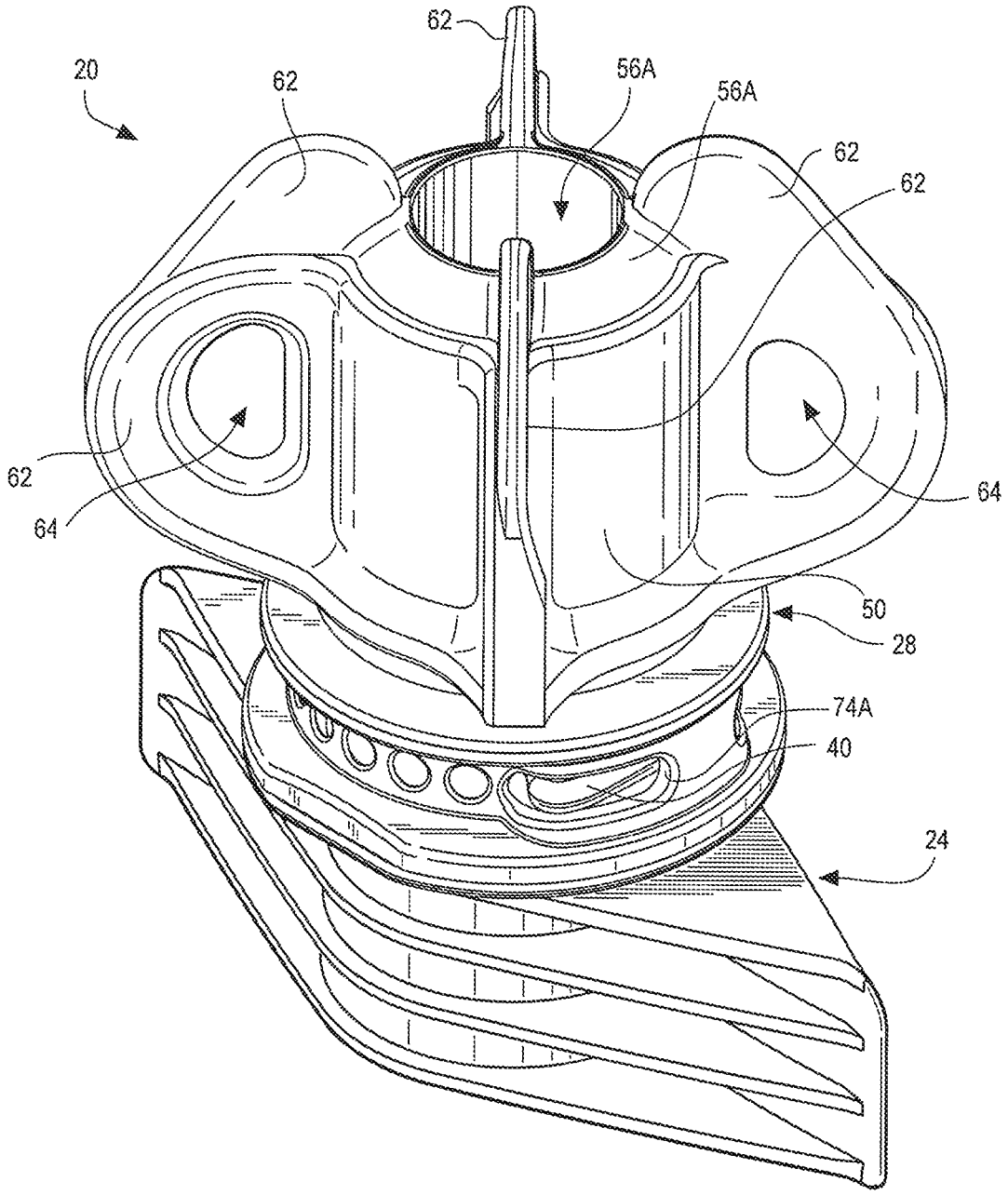
FIG. 1 is a perspective view taken from above a closure assembly of the present invention shown with a cap (also called an overcap) and a fitment in an initially assembled orientation for subsequently being installed on a pouch type container (not illustrated) in which a product may be stored—the closure assembly, container, and product therein together constituting a "package"
Figure 2:
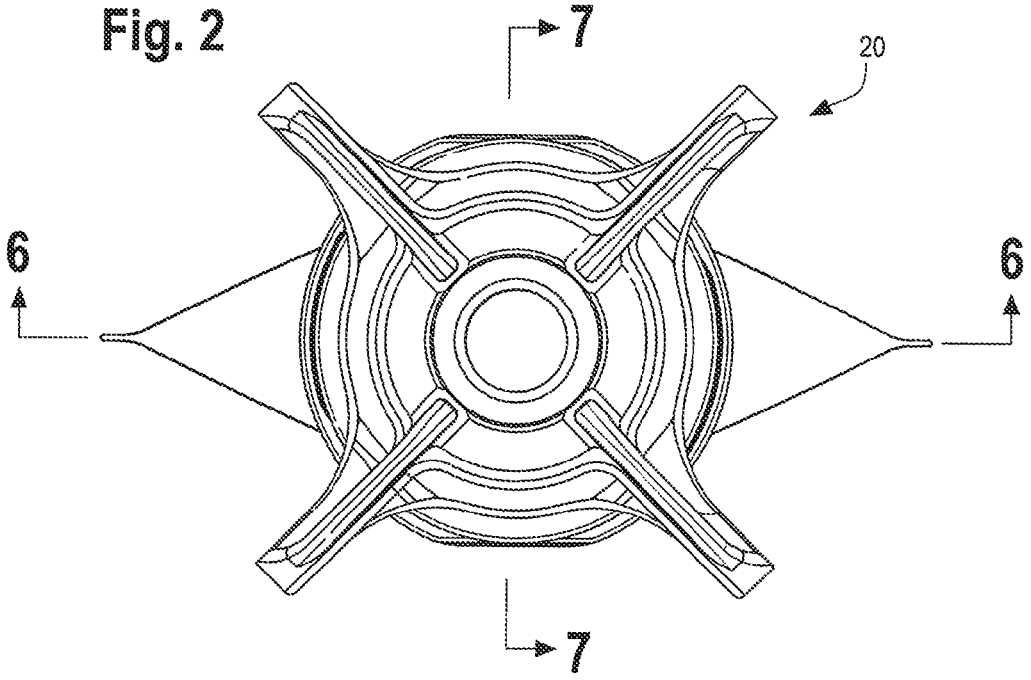
FIG. 2 is a top plan view of the closure assembly shown in FIG. 1.

While this invention is susceptible of embodiment in different forms, this specification and the accompanying drawings disclose only some specific embodiments as examples of the invention. The invention is not intended to be limited to the embodiments so described, and the scope of the invention will be pointed out in the appended claims.

For ease of description, many figures illustrating the invention show a presently preferred embodiment of a closure assembly in the typical orientation that the closure assembly would have when it is installed at the opening of a container (which may be, for example, a flexible pouch), and terms such as upper, lower, inward, outward, axial, lateral, etc., are used with reference to this orientation. It will be understood, however, that the closure assembly may be manufactured, stored, transported, used, and sold in an orientation other than the orientation described.

The illustrated preferred embodiment of the closure assembly of this invention can be modified for use with a variety of conventional or special containers, the details of which, although not fully illustrated or described, would be apparent to those having skill in the art and an understanding of such containers. The particular containers, per se, that are described herein form no part of and therefore are not intended to limit, the broad aspects of the present invention.

The illustrated embodiment of the closure assembly will typically be used on a container in the form of a collapsible, flexible pouch that contains a material or substance (e.g., a product such as a fluent food (e.g., yogurt), drink substance, or lotion) that can be imbibed, dispensed, or otherwise removed, from the container through the opened closure assembly. The product may be, for example, a fluent material such as a liquid, cream, gel, powder, slurry, or paste. If the container and closure assembly are large enough, then the product could also be non-fluent, discrete pieces of material (e.g., food products such as nuts, candies, crackers, cookies, etc., or non-food products including various items, particles, granules, etc.) which can be removed through an open closure assembly by hand from a container, or scooped out of a container, or ladled out of a container, or poured out of a container. Such materials may be, for example, a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

An embodiment of a closure assembly, and components thereof, incorporating the present invention are illustrated in the Figures wherein the closure assembly is designated generally by reference number 20. In the particular illustrated embodiment, the closure assembly 20 is provided in the form of a separate closure assembly 20 (FIG. 1) which is especially suitable for being attached to a container (not illustrated), such as a flexible, collapsible pouch that would typically contain contents such as a product consisting of a fluent material. The illustrated preferred embodiment of the closure assembly incorporating the present invention can be modified to other embodiments (not illustrated), for use on a container that could be a carton, or may be a generally rigid or semi-rigid container.

Where the container has the form of a pouch, then the pouch, or a portion thereof, may be made from a material suitable for the intended application (e.g., a thin, flexible material for a pouch wherein such a material could be a polyethylene terephthalate (PET) film or a polyethylene film). Where the container has the form of a bottle, then a thicker, less flexible material for a bottle may be used (e.g., a less flexible material could be injection-molded polyethylene or polypropylene).

In applications wherein the closure assembly 20 will be mounted to, or installed on, a thermoplastic container (e.g., a flexible, collapsible pouch), it is contemplated that the closure assembly manufacturer would typically make the closure assembly components by molding the components from a thermoplastic polymer and would then assemble them together in an initially assembled orientation defining a fully closed condition. The closure assembly manufacturer would then ship the closed closure assembly 20 to a container filler facility at another location where the container is either manufactured or otherwise provided, and where the container is filled with a product. However, for some applications, the components of the closure assembly 20 could be shipped by the manufacturer in an unassembled condition to the filler facility where they could be assembled by the packager or filler before or during the process of manufacturing the completed package containing the product.

In some cases, a packager or filler may want to sterilize or otherwise clean the closure assembly components or the closed closure assembly 20 before installing the closure assembly 20 on the container. Some packagers or fillers typically clean or sterilize the packaging components (including a closure assembly 20) in a cleaning chamber (which may be, or may include, a sterilizing chamber) wherein a cleaning gas or sterilizing gas (e.g., hydrogen peroxide gas) flows through the chamber in contact with the packaging component or components. The closed closure assembly 20 of the present invention can accommodate cleaning, especially hydrogen peroxide gas sterilization, in a way that can result in enhanced cleaning or sterilization of the closed closure assembly 20.

In the illustrated preferred embodiment of the invention, the closure assembly 20 (FIG. 1) includes (1) a lower element 24, which may also be characterized as a receiving structure, body, base, or fitment (FIG. 9), and (2) an upper element 28, which may also be characterized as a closing element, cover, cap, or overcap (FIG. 9) which is adapted to be installed on, and removed from, the lower element 24. Generally, the term "fitment" will be used throughout the specification and claims to refer to the element 24, and the terms "overcap" or "cap" will be used throughout the specification and claims to refer to the element 28.

The fitment 24 and the overcap 28 are each preferably molded from a suitable thermoplastic material such as polyethylene, polypropylene, or the like. In a presently preferred form of the closure assembly 20, the fitment 24 and the overcap 28 are preferably each molded separately from high density polyethylene (HDPE). Other materials may be employed instead.

The fitment 24 and the overcap 28 would typically be separately molded by the manufacturer and assembled together to form the closure assembly 20 for shipment to a packager or filler at another location for installation on a container (e.g., a flexible pouch (not illustrated)—with or without sterilization (or other cleaning) being effected prior to installation.

FIG. 1 illustrates the completed closure assembly 20 with the overcap 28 installed in an initially closed condition on the fitment 24. FIG. 1 may be characterized as also illustrating the overcap 28 and fitment 24 in an initially assembled orientation which prevents, but can be subsequently operated to permit, communication therethrough. Typically, in order to permit communication through the fitment 24 of the closure assembly 20, the overcap 28 is removed by the user from the fitment 28. In the preferred embodiment illustrated, the overcap 28 is unscrewed from the fitment 24 and lifted away so as to afford sufficient access to the fitment 24 (the fitment 24 being shown in FIG. 9 without the overcap 28 installed thereon). As explained hereinafter, in one preferred form of the closure assembly 20, the user's initial or partial opening of the closure assembly 20 will permanently alter the physical condition of the overcap 28 so as to create or provide a "tamper-evident" indication to subsequent users of the initial opening or partial opening.

Figure 9:
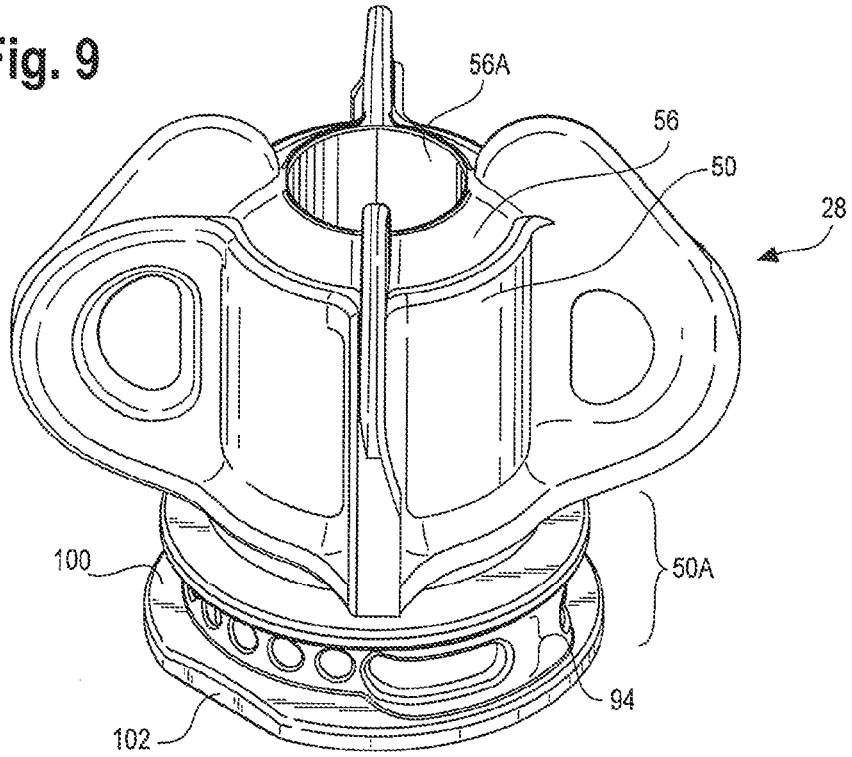
FIG. 9 is an exploded, perspective view of the closure assembly shown in FIG. 1.
Figure 9:
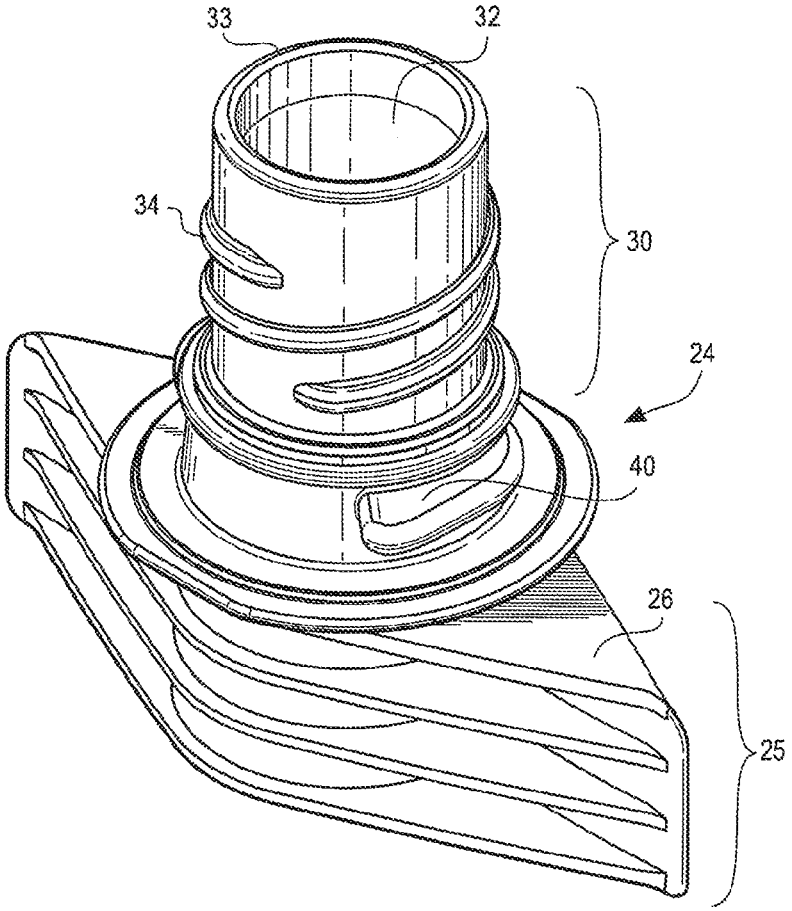
Figure 10:
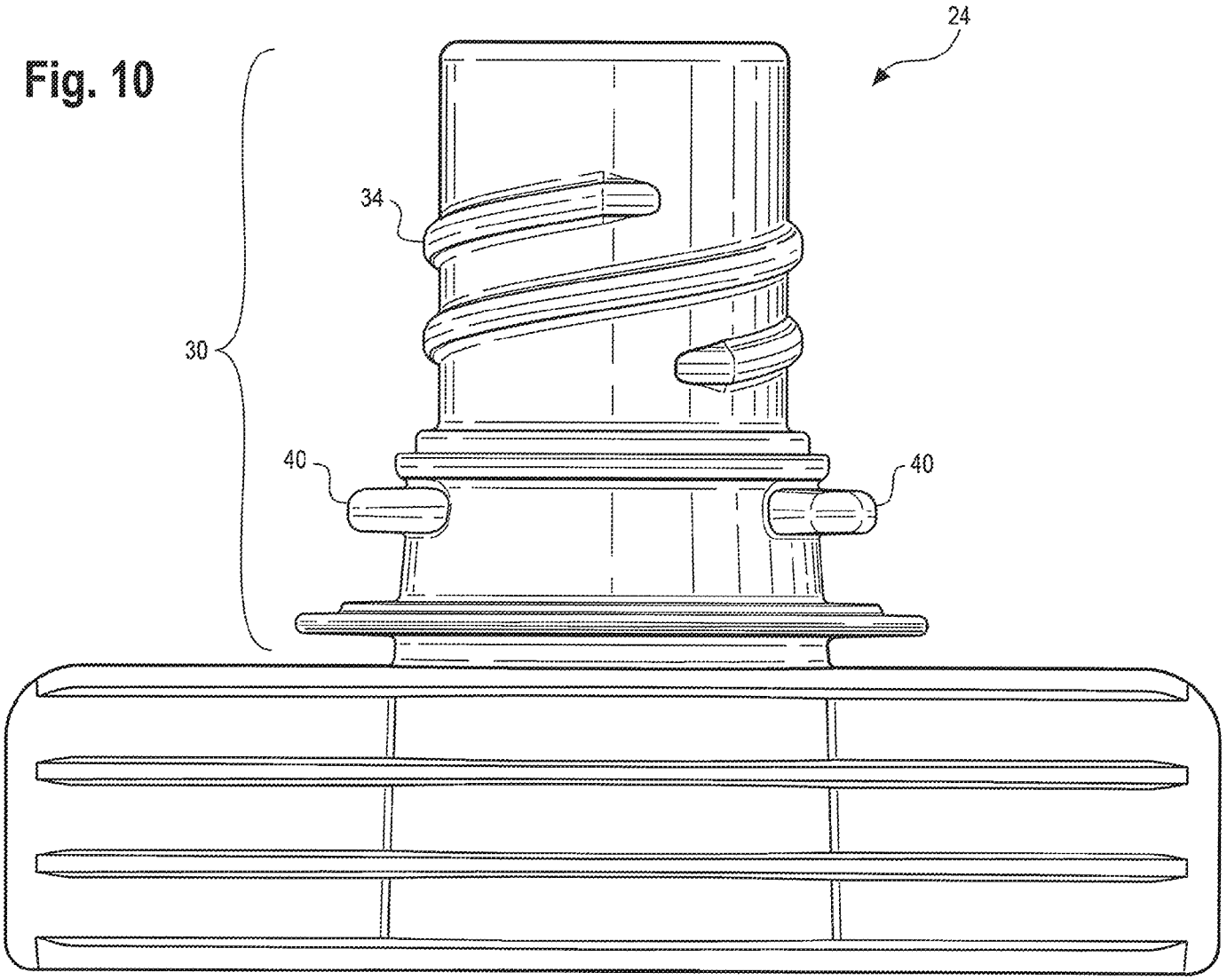
FIG. 10 is a front elevation view of just the fitment of the closure assembly shown in FIG. 9.

With reference to FIG. 9, the fitment 24 includes a spout 30 which defines an internal access passage 32 through the fitment 24 and which has a rim 33 (FIG. 9) defining a distal open end from which a product can be discharged, or into which a product can be introduced. The term "spout" is used herein in the sense of a tall or a short, upwardly (i.e, axially outwardly) extending boss or other structure defining the access passage 32.

In the illustrated embodiment, the spout 30 also includes one cam 34 (FIGS. 9 and 13) or cam follower 34, such as the illustrated helical thread 34. The fitment spout thread 34 could be regarded as either a cam per se or a cam follower per se for engaging a thread 70 on the overcap 28 (FIG. 19) as described hereinafter. That is, if the fitment thread 34 is regarded as a cam, then the overcap thread 70 may be regarded as a cam follower. On the other hand, if the fitment thread 34 is regarded as the cam follower, then the overcap thread 70 may be regarded as the cam. In either case, it is to be realized that the relative rotational movement between the overcap 28 and the fitment 24 could result from rotating the overcap 28 relative to the fitment 24 being held stationary, or could result from rotating the fitment 24 (along with the attached container system) relative to the overcap 28 being held stationary, or could result from rotating both the overcap 28 and fitment 24 simultaneously in opposite directions. In the illustrated preferred embodiment, the thread 34 and the thread 70 are each a dual lead helical thread having an identical predetermined pitch.

Figure 14:
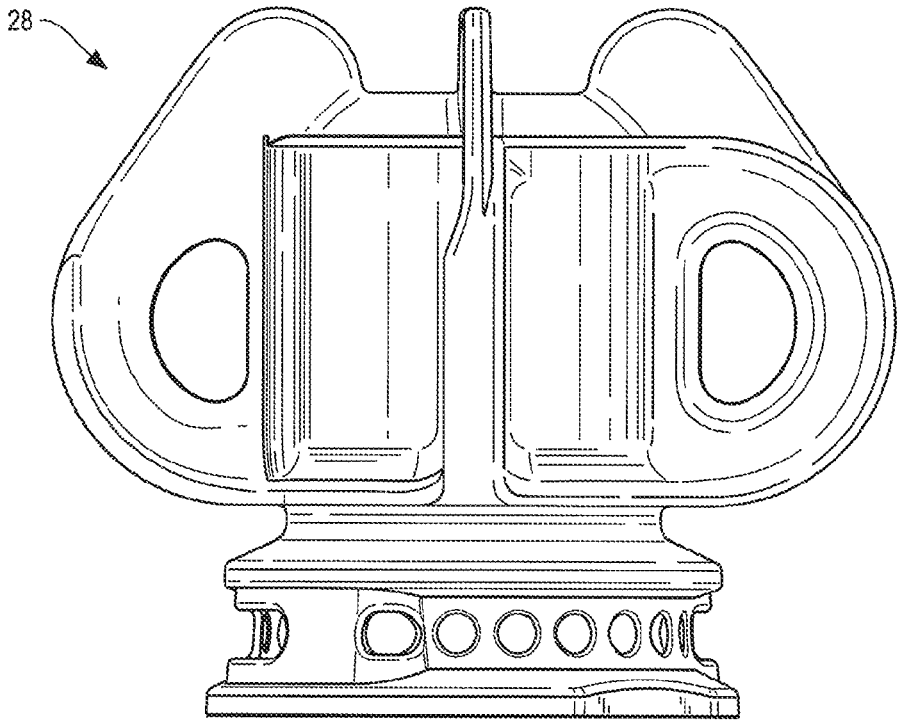
FIG. 14 is an elevation view of just the overcap of the closure assembly shown in FIG. 9.
Figure 18:
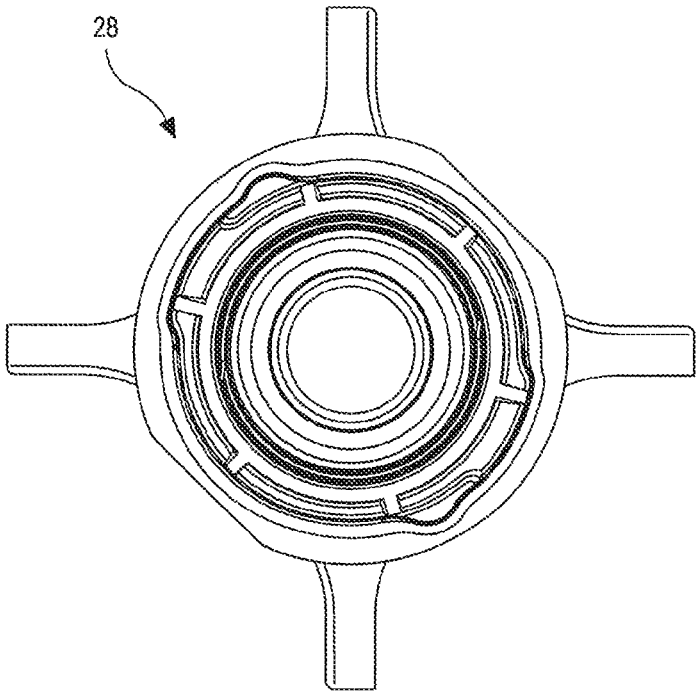
FIG. 18 is a bottom plan view of the overcap shown in FIG. 14.

The fitment 24 also includes at last one laterally projecting shear member 40. In the preferred embodiment illustrated in FIGS. 8, 9, and 14 there are two such laterally projecting shear members 40 located below the thread 34. The shear members 40 may be located on, or as part of, the spout 30, or may be located below the spout 30. The structure of the spout threads 34 and shear members 40 is substantially the same as the structure of the spout threads 34 and shear members 40, respectively, as disclosed in the international patent application No. PCT/US2013/68209.

Opposite the distal open end of the fitment access passage 32 (FIG. 9), the receiving structure or fitment 24 may include a suitable structure for being mounted to a substance containment system (e.g., a collapsible, flexible pouch (not illustrated) or a bottle (not illustrated), or other structure of a system to which the closure assembly 20 is intended to be attached). For use with a collapsible, flexible pouch, the bottom portion of the fitment 24 typically includes a suitable conventional or special, "boat-shaped," heat-sealable base 25 (FIG. 9) the details of which form no part of the broad aspects of the present invention). The base 25 can be attached to the open end of a pouch with suitable, conventional heat sealing techniques. The base 25 has a top end surface or outer end 26 (FIGS. 9 and 13) at the top of the fitment base sides which are adapted to be heat sealed to the webs of thermoplastic material defining the side walls of the pouch (not illustrated).

If the containment system is a bottle, then it is presently contemplated that most bottlers would prefer to have the closure assembly 20 provided to them with the receiving structure or fitment 24 not only including the thread 34 (i.e., cam 34 or can follower 34), but also including a suitably shaped base or bottom that is particularly configured with a snap-fit attachment feature or threaded attachment feature (the details of which form no part of the present invention) for installation of the closure assembly 20 on the bottle which would have a suitable, mating attachment configuration.

Further, other means of attaching the closure assembly receiving structure or fitment 24 to the container (not illustrated), or to another system, are contemplated. These other means could include, for example, adhesive.

Figure 13:
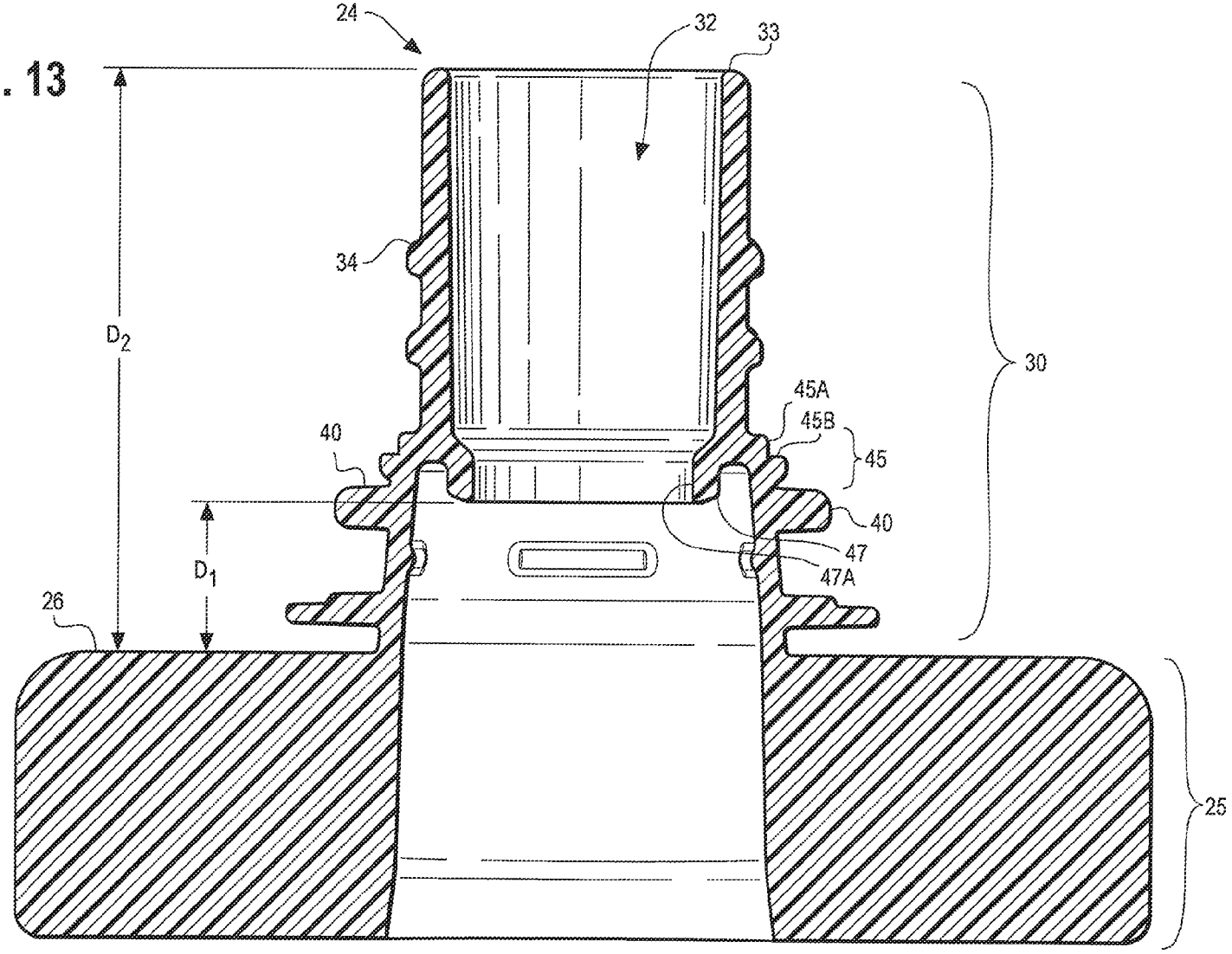
FIG. 13 is a cross-sectional view of the fitment taken along the plane 13-13 in FIG. 11.

The access passage 32 in the spout 30 of the fitment 24 can be seen in FIG. 13. The access passage 32 extends from the distal, outer end rim 33 of the spout 30 and through the rest of the fitment 24. The access passage 32 communicates with an opening of the pouch or bottle (not illustrated) or other system, and the passage 32 permits material (gases, fluids, solids, etc.) to pass between the exterior and the interior of the system. It is to be understood that the access passage 32 need not be circular as shown. The access passage 32 may be elliptical, polygonal, or some other regular or irregular shape.

With reference to FIG. 13, the spout 30 defines an exterior sealing surface in the form of an exterior shoulder 45 having a radially outwardly facing, cylindrical first portion sealing surface 45A and an upwardly facing, annular second portion sealing surface 45B.

Further, with reference to FIG. 13, the spout 30 has an interior annular projection 47 that, in the particular illustrated embodiment, is located axially below the exterior shoulder 45, and that extends laterally inwardly into the access passage 32 to define an easily sealable, interior sealing surface 47A, which, in the presently preferred form illustrated, is generally cylindrical and faces radially inwardly.

With reference to FIG. 13, for one embodiment that has been designed, the distance D1 from the bottom of the interior sealing surface 47A to the top end surface 26 of the fitment base 25 is 5.46 mm, and the distance D2 defined between the top of the spout 30 and the top of the base 25 is 20.83 mm. D1 is preferably less than half the distance D2.

Figure 11:
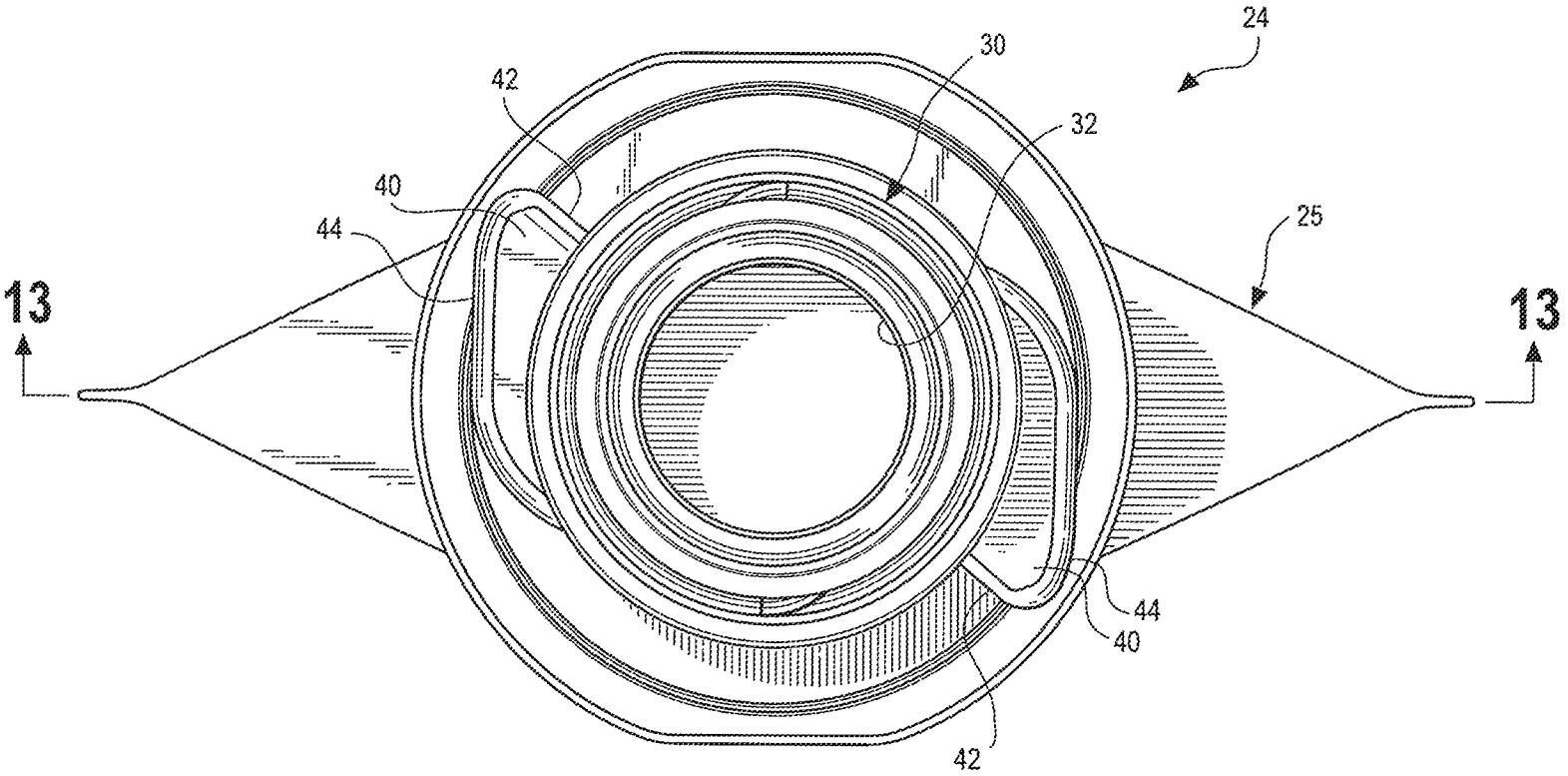
FIG. 11 is a top plan view of the fitment shown in FIG. 10.
Figure 12:
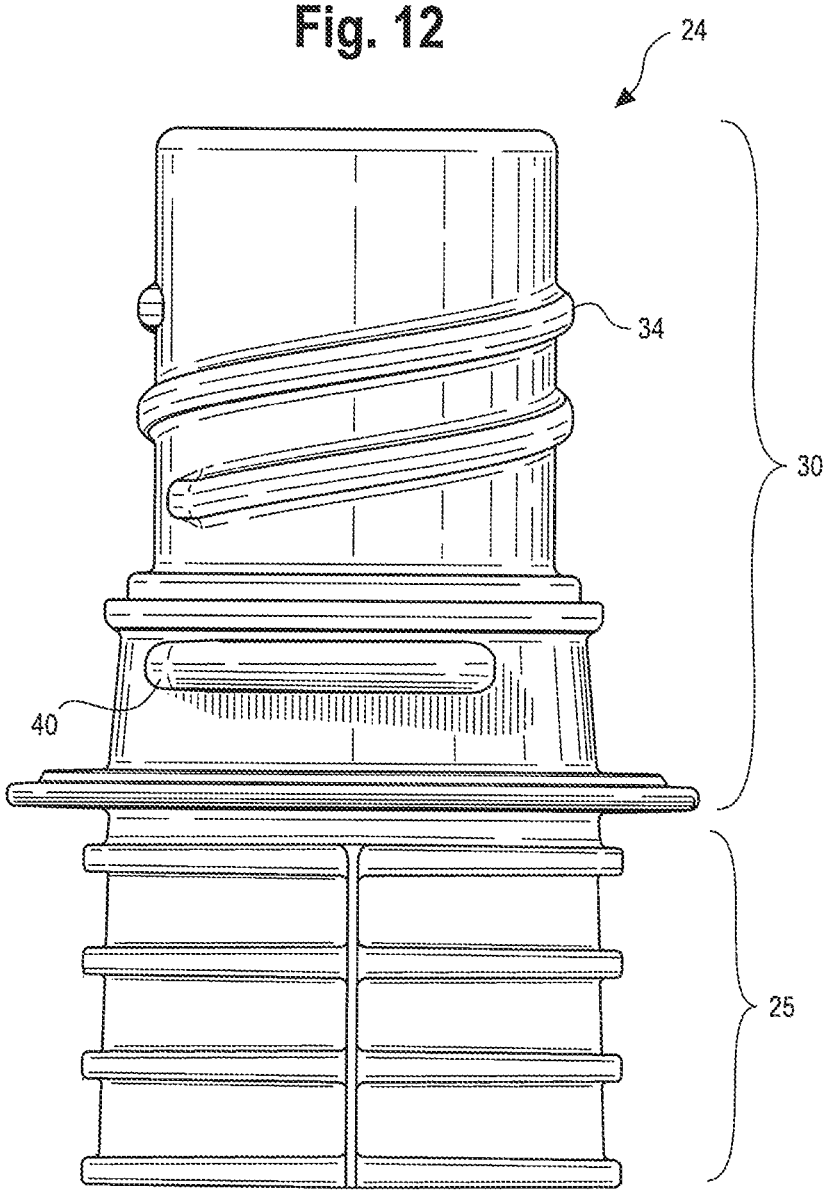
FIG. 12 is a right side elevation view of the fitment shown in FIG. 10.

As can be seen in FIG. 11, each shear member 40 has a leading edge 42 and a trailing edge 44. Each shear member 40 may alternatively be described as a shear fin. Preferably, each shear fin or shear member 40 is relatively smooth to accommodate intentional or accidental contact of the shear member 40 by a user's finger and/or lip.

The overcap 28 is adapted to be installed on the fitment 24 in an initially assembled orientation defining an initially fully closed condition. In this condition, a combination of the overcap 28 and fitment 24 together define an initially assembled orientation which prevents, but can be subsequently operated to permit, communication through the fitment. The operation to permit communication through the fitment 24 is the unscrewing of the overcap 28 from the fitment 24 as described hereinafter.

Figure 3:
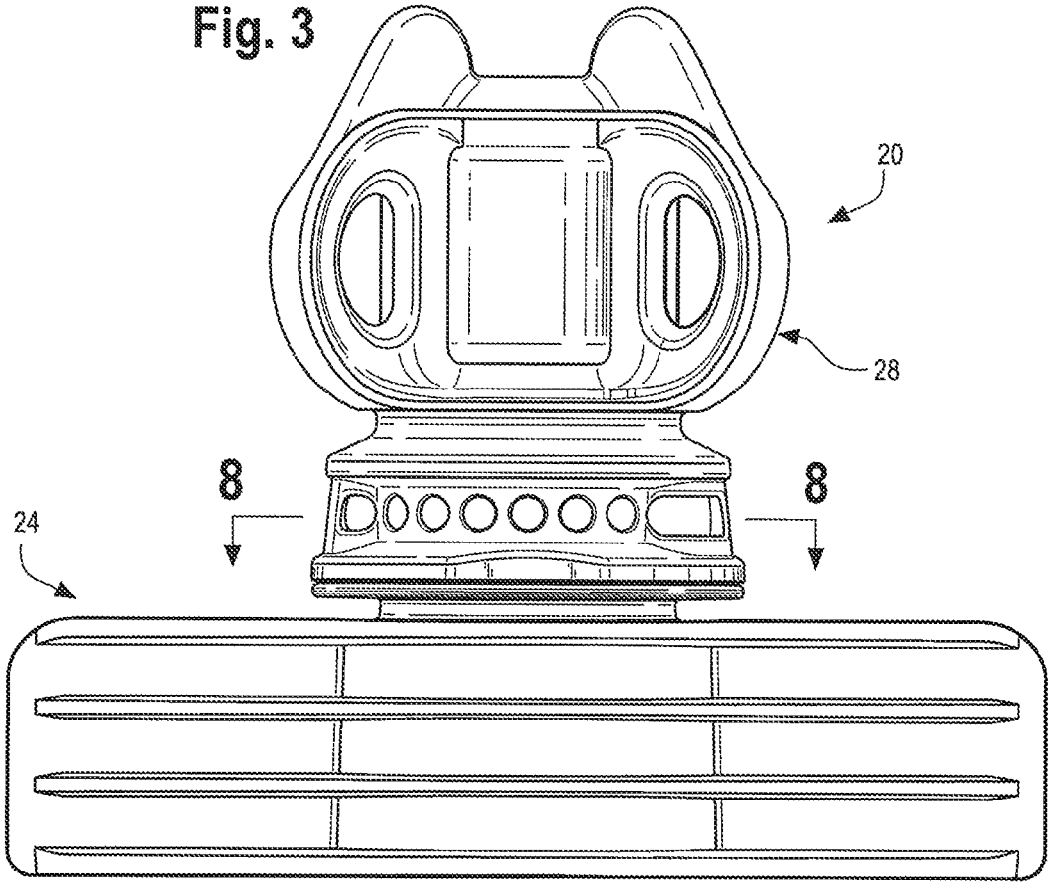
FIG. 3 is a front elevation view of the closure assembly shown in FIG. 1.
Figure 4:
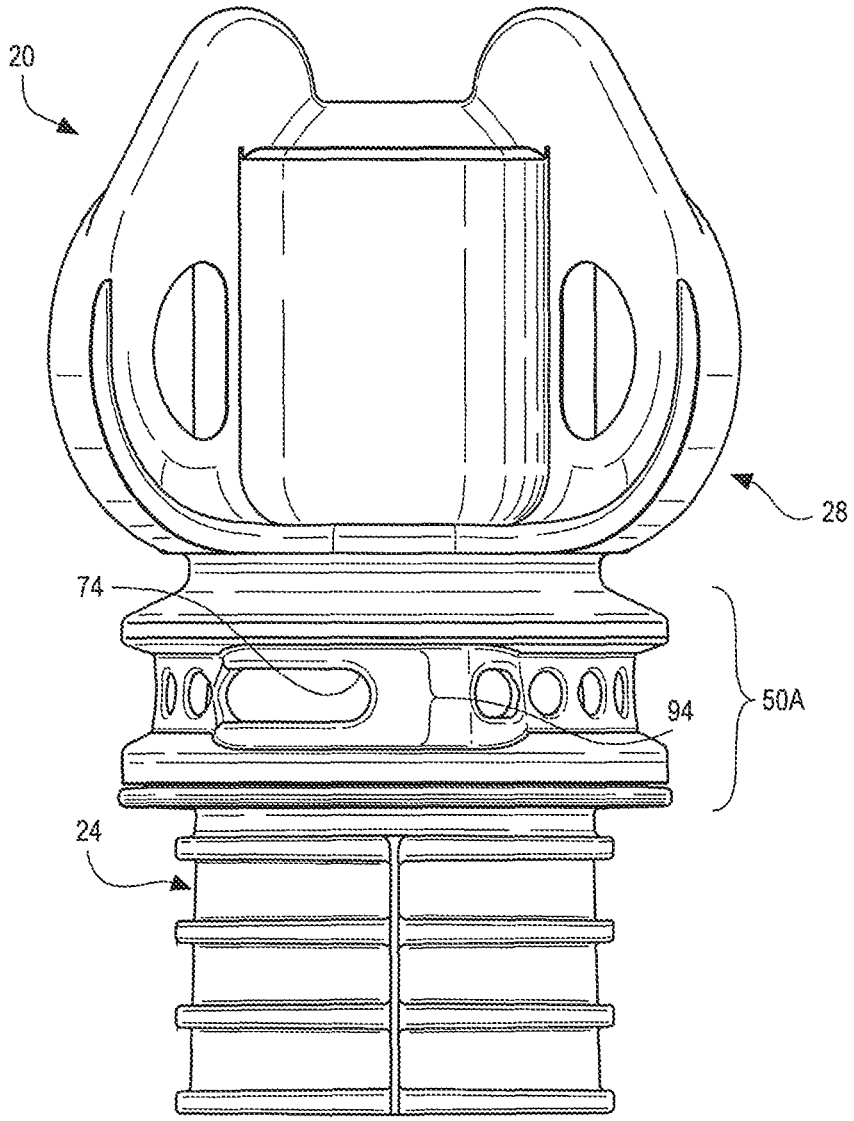
FIG. 4 is a right side elevation view of the closure assembly shown in FIG. 1.
Figure 5:
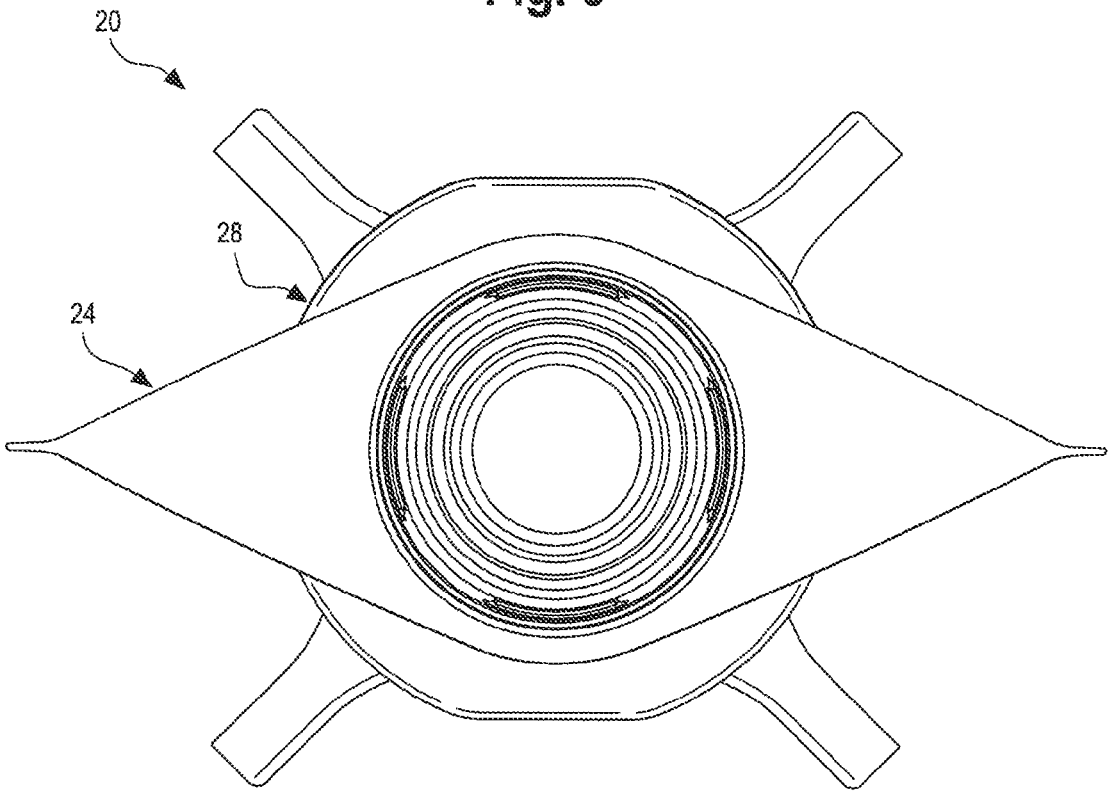
FIG. 5 is a bottom plan view of the closure assembly shown in FIG. 1.
Figure 6:
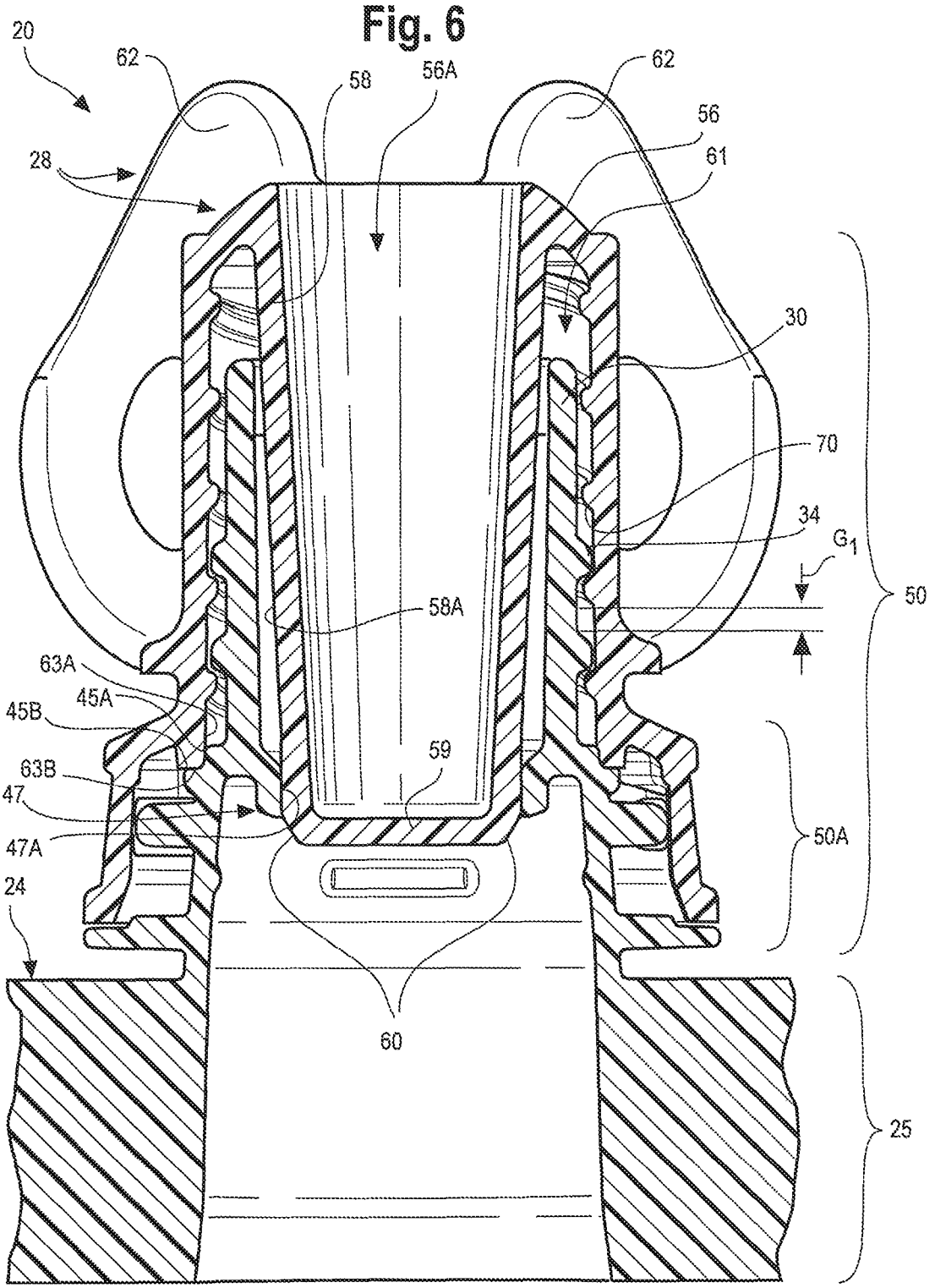
FIG. 6 is a cross-sectional view of the closure assembly taken along the plane 6-6 in FIG. 2.
Figure 7:
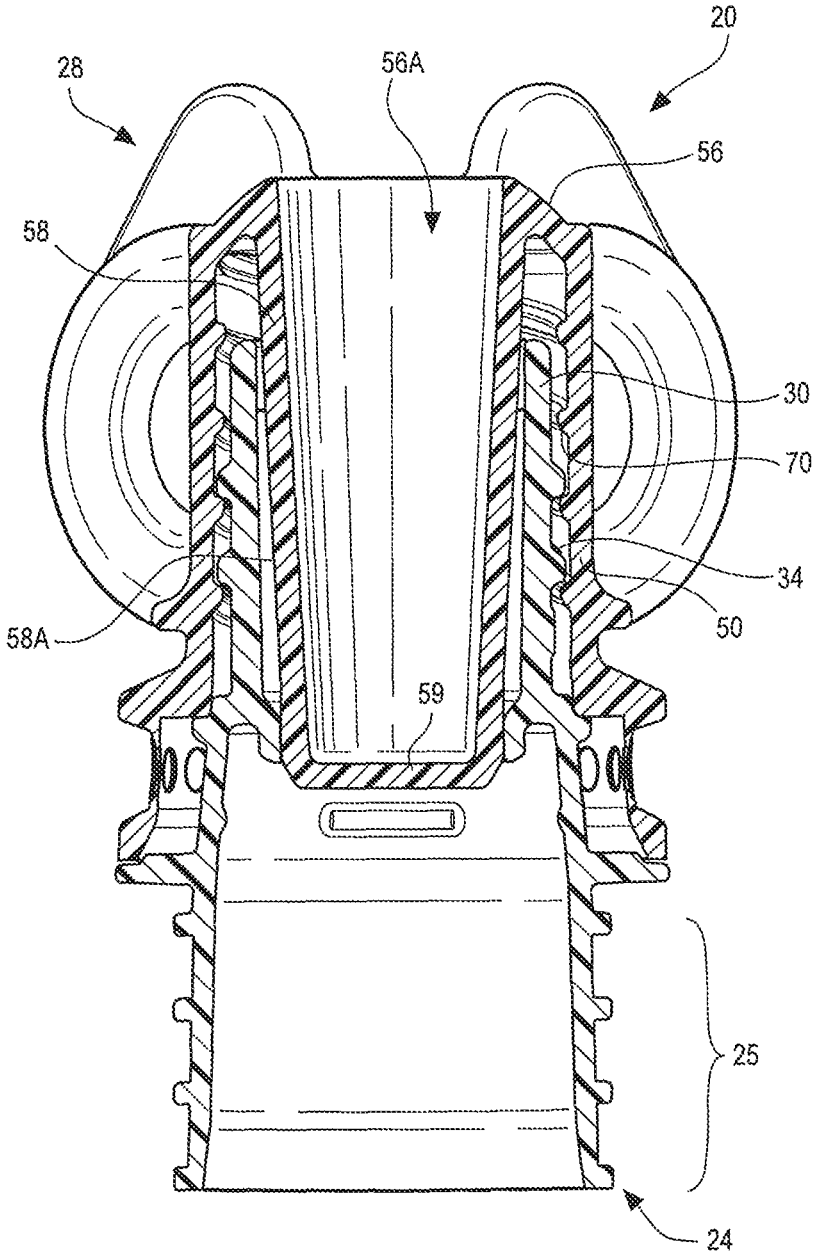
FIG. 7 is a cross-sectional view of the closure assembly taken along the plane 7-7 in FIG. 2.

In the illustrated preferred embodiment, the overcap 28 has a skirt 50 (FIG. 9) for engaging at least a portion of the fitment spout 30 as can be seen in FIG. 7. Further, as can be seen in FIG. 9, the upper end of the overcap skirt 50 terminates in a peripheral, annular end portion 56 around a recess 56A. As can be seen in FIGS. 6 and 9, the skirt 50 is defined by a generally cylindrical sleeve having a larger diameter, lower end portion 50A. With reference to FIGS. 3 and 6, the overcap skirt 50 and its lower end portion 50A define an open end (not numbered) into which the fitment spout 30 extends to accommodate relative rotation between the overcap 28 and the fitment 24.

As can be seen in FIG. 6, depending downwardly from the inside of the overcap 28 is an internal clean out plug or seal plug 58 which has a frustoconical, exterior sealing surface 58A to sealingly engage the interior sealing surface 47A on the inside of the fitment spout 30 to establish a first seal when the overcap 28 and fitment 24 are in the initially assembled closed condition.

The overcap plug 58 is closed at its bottom end by an end wall 59 (FIG. 6) which defines the bottom of the overcap recess 56A and which also defines on its periphery a frustoconical surface or chamfer 60 for accommodating insertion of the lower end of the plug 58 into, and against, the fitment spout seal surface 47A (FIG. 6) on the fitment spout projection 47. The design can also incorporate some flexibility in the spout annular projection 47 to accommodate insertion of the overcap plug 58.

The overcap 28 has an annular space or channel 61 (FIG. 19) defined between the plug 58 and the skirt 50 for accommodating the fitment spout 30 as can be seen in FIG. 6.

Figure 19:
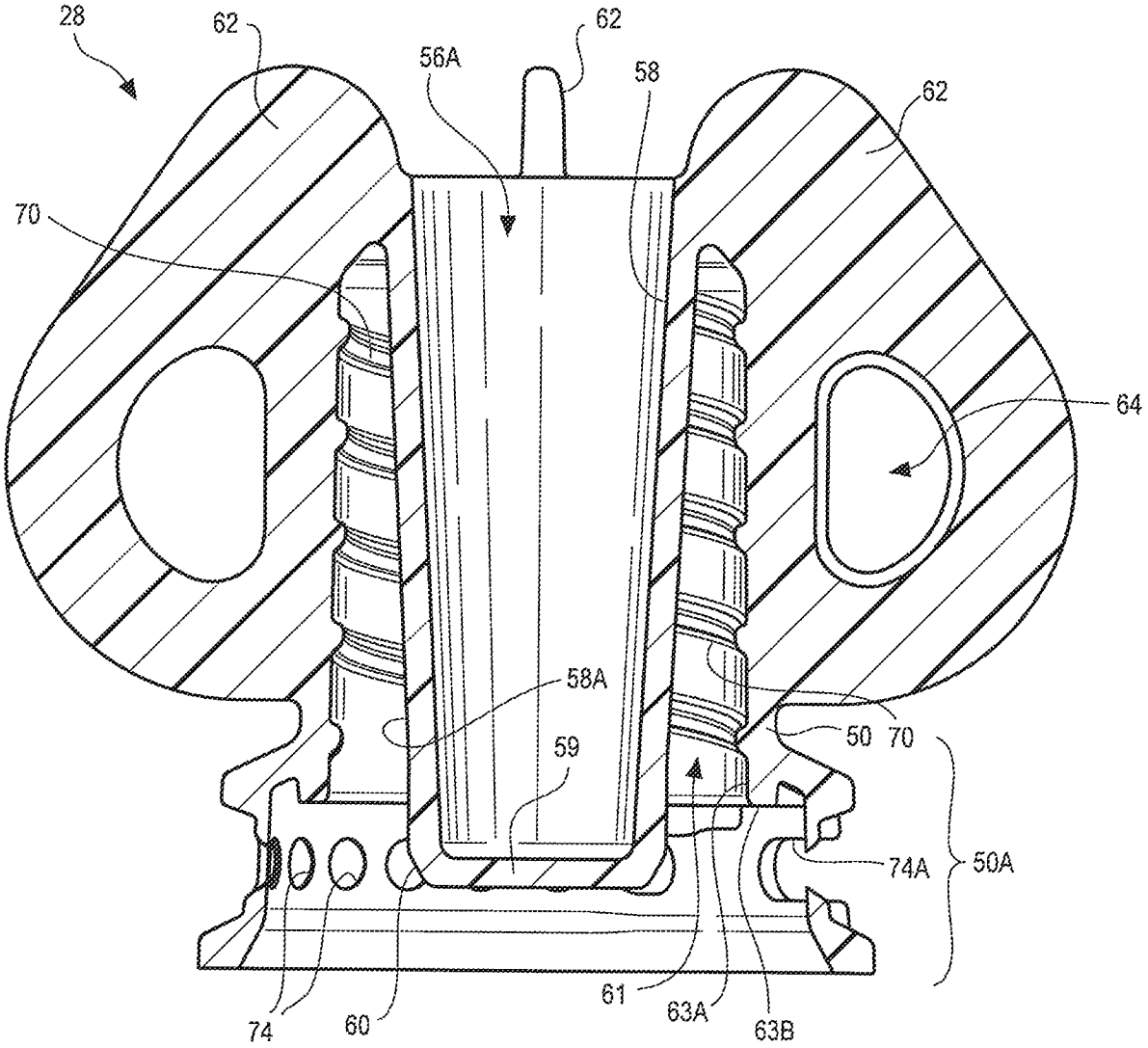
FIG. 19 is a cross-sectional view of the overcap taken along the plane 19-19 in FIG. 17.

As can be seen in FIGS. 6 and 19, the skirt 50 of the overcap 28 has a compound sealing surface in the form of cylindrical first portion sealing surface 63A and an annular second portion sealing surface 63B for sealingly engaging the fitment spout shoulder seal cylindrical first portion sealing surface 45A and annular second portion sealing surface 45B, respectively, when the overcap 28 and fitment 24 are in the initially assembled orientation (FIG. 6).

The novel engagement of the sealing configuration as defined by the overcap 28 and fitment 24 provides certain advantages. In particular, with reference to FIG. 6, the outer seal established by the overcap surfaces 63A, 63B with the fitment spout exterior shoulder sealing surfaces 45A, 45B can prevent, or at least inhibit, ingress of contaminants upwardly past the seal into the long thread region of the spout 30 prior to (and after) installation of the closure assembly 20 on a pouch or other system.

Also, as seen in FIG. 6, the low location of the inner seal established by the engaged interior spout sealing surface 47A with the lower portion of the overcap plug sealing surface 58A can prevent, or at least inhibit, ingress of contaminants upwardly past the seal into the region around the inside and outside of the spout 30 prior to installation of the closure assembly 20 on a pouch or other system.

The spout 30 may be relatively long (i.e., tall) in applications where it is desired to accommodate a person's mouth, including lips, for drinking a fluent product through the spout. Without an outer seal near the base of the spout 30 (as effected by engagement of the spout surfaces 45A and 45B with the overcap surfaces 63A and 63B, respectively), and without an inner seal near the lower end of the plug 58 (as effected by the engagement of the plug sealing surface 58A with the fitment spout sealing surface 47A), a relatively long length of the spout 30 would be susceptible to contamination prior to installation of the closure assembly 20 on a pouch or other containment system. If a packager wants to sterilize (or otherwise clean) the closure assembly 20 (comprising the assembled fitment 24 and overcap 28), then the efficiency and efficacy of the cleaning (e.g., sterilization) process can be enhanced by employment of the engaged sealing surfaces 45A/63A, 45B/63B, and 47A/58A which cooperate to define a sealed off, internal region that may then not need to be sterilized (or otherwise cleaned) after delivery of the closed closure assembly 20 to the packager.

The configuration of the long ("deep") overcap plug 58 and the engaging fitment spout interior seal surface 47A locates the inner or interior seal "low" in the spout, and that provides other advantages when the closure assembly 20 is used with containers (e.g., pouches) containing a product that could be adversely affected by the ingress of ambient atmosphere. For example, some types of pouches include a laminate layer of metal which has good barrier properties (e.g., low permeability) relative to ambient atmospheric gases. However, a thermoplastic closure assembly installed on such a type of pouch typically is more gas permeable than is the metal laminate pouch, and thus, such a thermoplastic closure assembly presents a lower barrier to atmospheric gases, including oxygen.

Some characteristics (e.g., color) of some products packaged in pouches can be adversely affected (e.g., change in color) by permeation of gases (e.g., oxygen) through portions of the thermoplastic closure assembly at the top of the pouch. Such undesirable effects can be reduced by the aspect of the present invention that relates to the overcap plug seal configuration which locates the overcap plug end wall 59 and the interior seal (defined by sealing surfaces 47A and 58A) near the bottom, inner end of the spout 30.

In particular, the positions of the overcap plug end wall 59 and of the interior seal defined by the engaged seal surfaces 47A and 58A (FIG. 6) at a relatively low elevation inside the spout 30 eliminate a large, internal, free volume in the spout above the product in the pouch to reduce the amount of atmospheric gases that are trapped in the spout above the product and that could adversely affect the product.

Further, the closure assembly configuration has two seals (i.e., inner seal surfaces 47A/58A, and outer seal surfaces 45A/63A, 45B/63B) to prevent gas ingress between the spout 30 and overcap 28.

Additionally, above the two seals, the closure assembly the configuration provides two annular wall structures (the annular wall of the skirt 50 and the annular wall of the spout 30) to impede the permeation of the ambient atmosphere oxygen or other gases.

Although the lower part of the wall of the spout 30 extending vertically between the inner seal (at the engaged surfaces 47A and 58A) and the fitment base 25 (which typically would be sealed to the low permeability metal laminate pouch) provides only a single wall thickness of thermoplastic material as a barrier in that lower region, the length of spout wall in that lower region is considerably less than what would exist if the inner seal was provided higher up, or if the inner seal was completely omitted. Thus, the configuration of the spout 30 and overcap plug 58 of the present invention can reduce the amount of ambient atmospheric oxygen (and other gases) passing through the closure assembly 20 to the product—thereby reducing the possibility of adverse effects on the product or reducing such adverse effects, per se.

Preferably, as can be seen in FIGS. 1 and 6, the overcap 28 also preferably includes tabs 62 on the outside of the overcap 28, and the tabs 62 are adapted to be engaged by a user's fingers and thumb to assist in rotating the overcap 28 relative to the fitment 24. In the preferred embodiment, as illustrated in FIG. 1, each tab 62 defines an aperture 64 which minimizes the amount of material required for forming each tab 62 and which may provide an additional gripping feature to permit the user's fingers and/or thumb to better engage one or more of the tabs 62.

With reference to FIG. 6, an inside portion of the overcap skirt 50 defines the cam 70 or a cam follower 70 which, in the illustrated preferred embodiment, is the previously identified helical thread 70 for engaging the helical thread 34 on the fitment spout 30. The thread 70 could be regarded either as a cam, per se, or a cam follower, per se, for engaging the fitment thread 34. That is, if overcap thread 70 is regarded as the cam, then fitment thread 34 would be regarded as the cam follower. On the other hand, if the overcap thread 70 is regarded as the cam follower, then the fitment thread 34 would be regarded as the cam. In either case, it is to be realized that the relative rotational movement between the overcap 28 and the fitment 24 could result from rotating the overcap 28 relative to the fitment 24 being held stationary, or could result from rotating the fitment 24 (and attached system (e.g., pouch or a bottle)) relative to the overcap 28 being held stationary, or could result from rotating both the overcap 28 and fitment 24 (and attached system) simultaneously in opposite directions.

In the illustrated preferred embodiment, each thread 34 and 70 is a dual lead helical thread having a predetermined pitch. The pitch is selected to provide an initial gap G1 (FIG. 6) between the threads 34 and 70 when the overcap 28 and fitment 24 are in the initially assembled orientation (FIGS. 6 and 7).

In the preferred embodiment illustrated in FIGS. 6 and 7, the overcap thread 70 is defined in an upper portion of the skirt 50. Between the thread 70 and the open bottom end of the skirt 50, the skirt 50 has a lower, larger diameter, portion 50A that has a tamper-evident function and that defines two apertures 74 (FIGS. 16 and 20) each extending in an are around part of the skirt 50. The two apertures 74 are each divided into smaller holes or openings by one or more frangible bridges 78.

Figure 15:
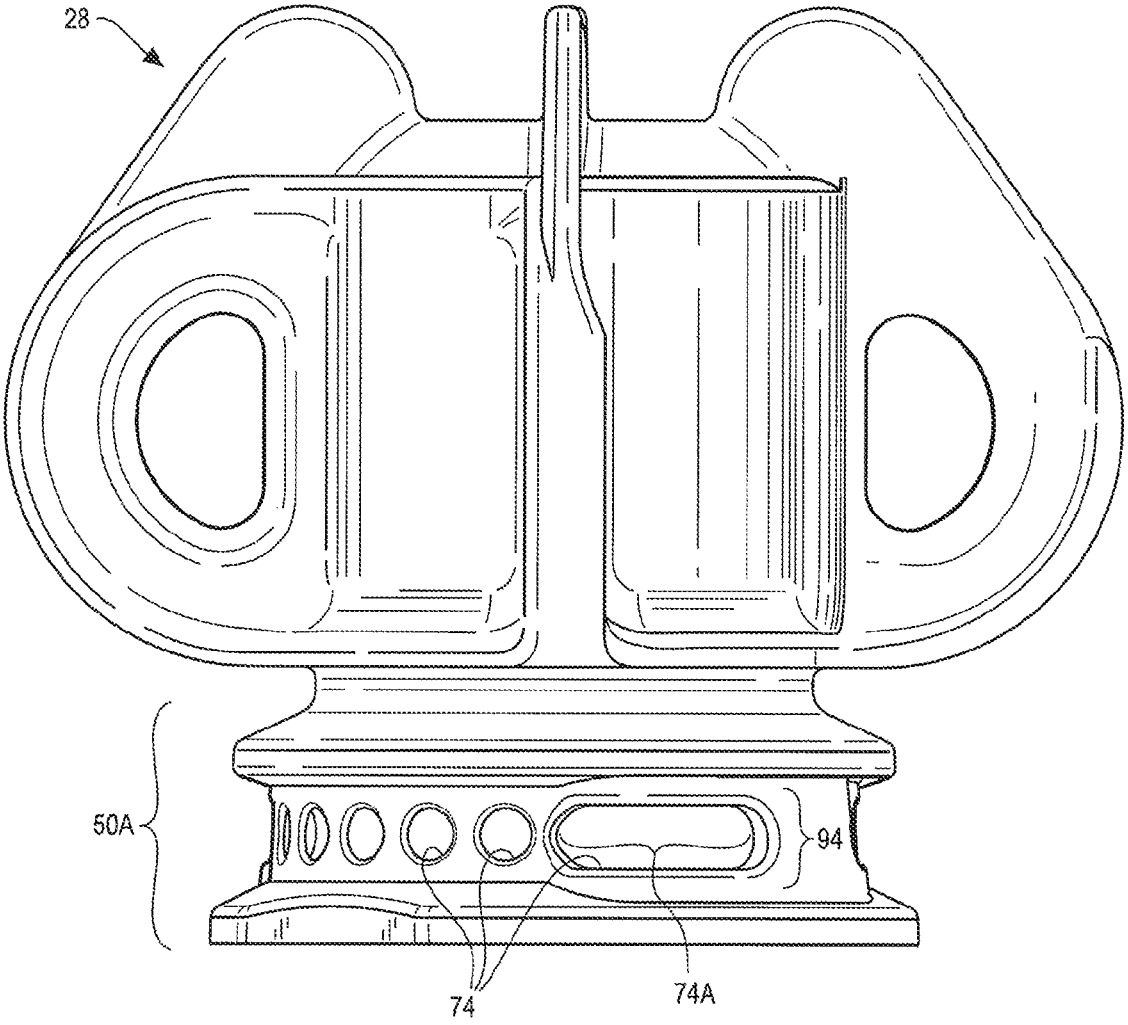
FIG. 15 is another elevation view of the overcap shown in FIG. 14, but in FIG. 15 the overcap is shown rotated 90 degrees from the position of the overcap shown in FIG. 14.
Figure 16:
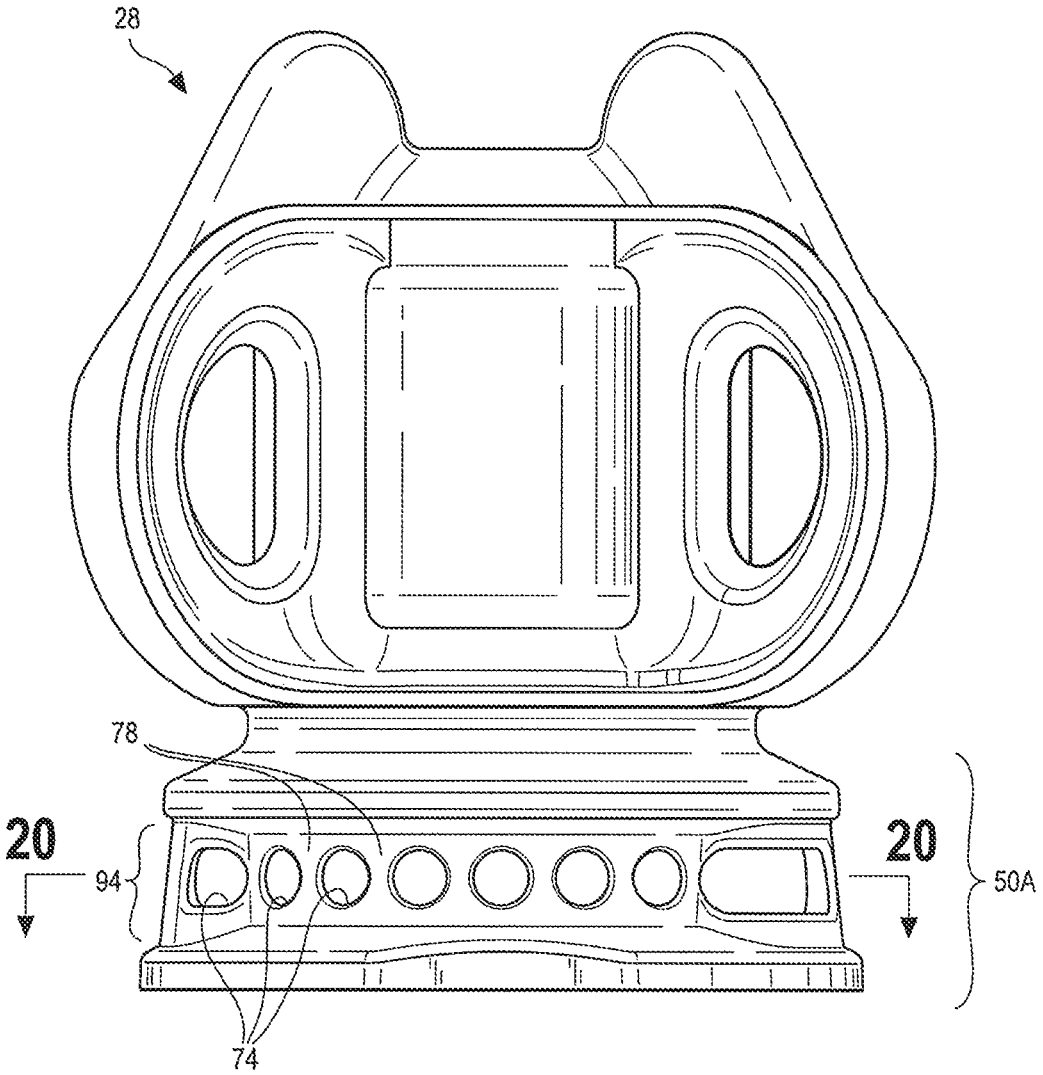
FIG. 16 is a front elevation view of the overcap shown in FIG. 14.
Figure 17:
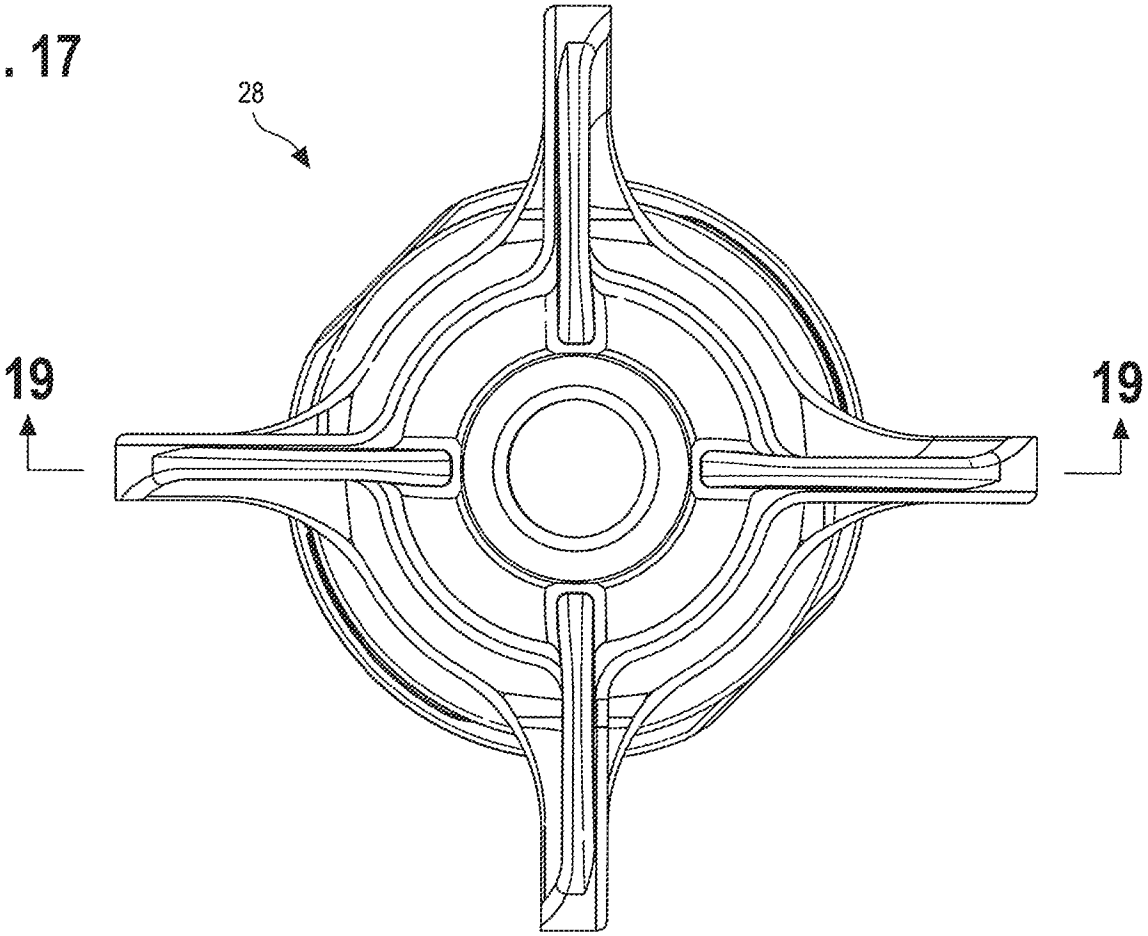
FIG. 17 is a top plan view of the overcap shown in FIG. 14.
Figure 20:
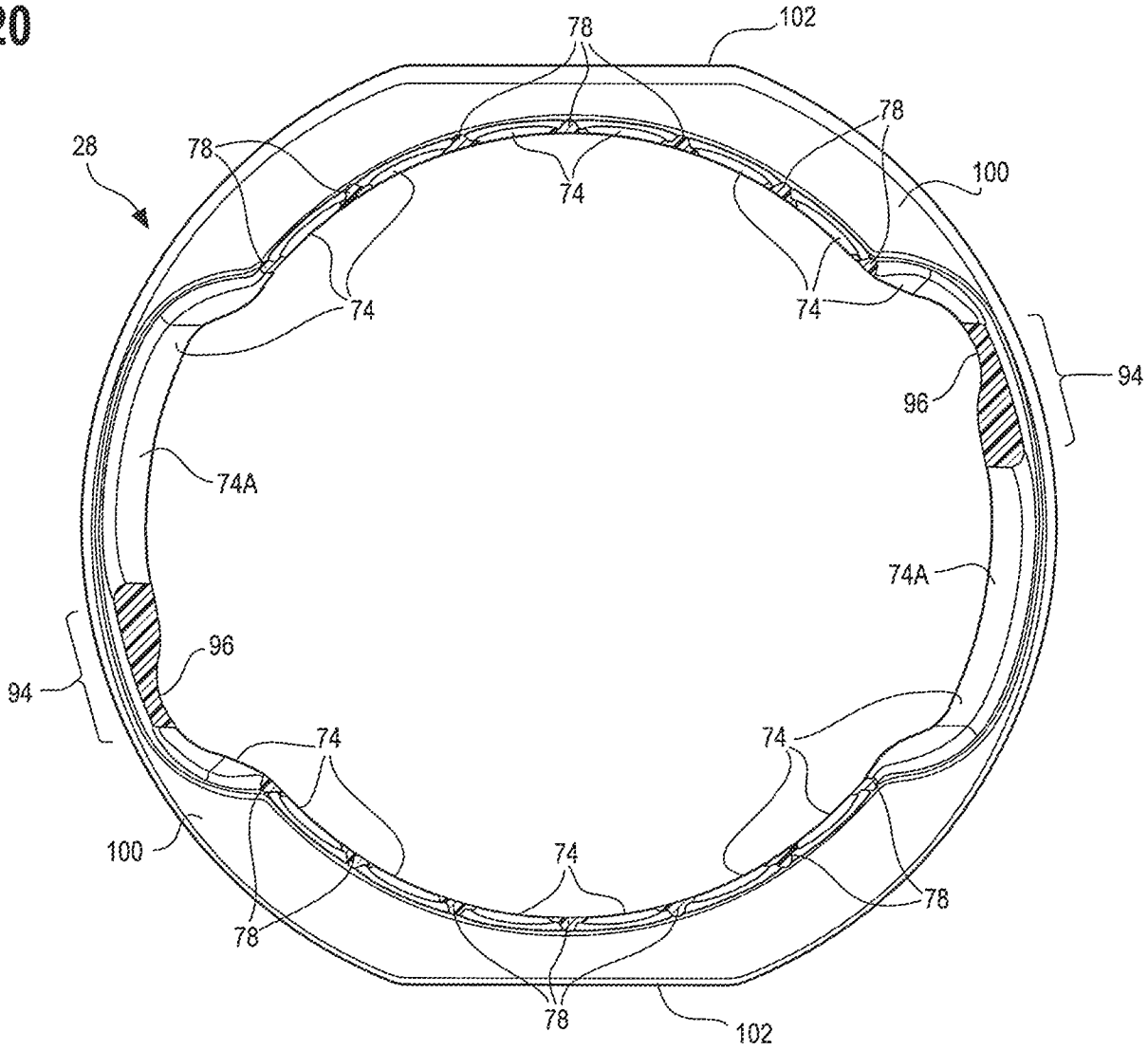
FIG. 20 is a cross-sectional view of the overcap taken along the plane 20-20 in FIG. 16.

In the preferred embodiment illustrated in FIG. 16, a plurality of frangible bridges 78 extend across each aperture 74 to divide each aperture 74 into a plurality of smaller holes or openings that are each separated from an adjacent smaller hole or opening by one of seven frangible bridges 78. With reference to FIGS. 15 and 20, there are seven of the smaller openings which are small circular holes, but each aperture 74 also has another portion, which is designated 74A in FIGS. 15 and 20, that is larger than each of the seven circular holes and that has a generally elongate shape or oval shape.

In the preferred embodiment illustrated, and with reference to FIGS. 16, 19, and 20, the skirt lower portion 50A of the overcap 28 defines two such elongate apertures 74A located 180° apart. Each such elongate aperture 74A is associated with the seven smaller circular holes which, together with the elongated opening 74A, comprise the one large aperture 74 divided by the seven frangible bridges 78.

Each bridge 78 that is defined between two of the smaller adjacent holes has concave sides which define a bridge structure with a narrow middle portion between wider top and bottom end portions. With reference to FIG. 20, each bridge 78 has a flat, or very slightly curving, interior surface, but each bridge 78 has an exterior surface which, as viewed in transverse cross section in FIG. 20, defines a radially outwardly bulging configuration which can be impinged by, and cause a desirable turbulence in, a gas flow, such as during sterilization of the closure assembly 20 by a packager prior to installation of the closure assembly 20 on a container (not illustrated). This can enhance the efficiency of the sterilization process.

The arcuate shape of bridge narrow middle portion between the top and bottom end portions of each bridge 78 also minimizes the effect of restricted flow of molten plastic resin during molding of the overcap 28, and that accommodates a better filling pattern of the molten plastic resin flow during molding so as to provide a better mold fill with a reduced likelihood of creating undesirable voids or cavities. This provides a wider processing window with respect to the injection molding machine.

The shape of the frangible bridge 78 is not difficult to mold, and provides a greater strength even though the bridge 78 is relatively thin at the narrowest point. This allows the designer to maximize the vertical height of the bridge 78. The opposite sides of the bridge 78 define the tapering shape leading to the narrow part of the bridge 78, and that shape accommodates a thicker, stronger shear member 40 in an adjacent portion of the aperture 74 when the overcap 28 is rotated relative to the fitment 24 as is described in detail hereinafter.

There may be fewer than seven circular holes defining part of the aperture 74, or there may be more than seven such circular holes. That is, the number of frangible bridges 78 extending across the aperture 74 to define the smaller holes may be fewer than seven or may be more than seven. As viewed in FIGS. 15 and 16, most of the frangible bridges 78 have oppositely facing sides that each has a concave configuration that defines the above-described tapering shape which provides the above-described advantages.

As can be seen in FIGS. 9, 15, 16, and 20, the upper portion of the overcap skirt 50A is joined by at least one non-frangible, but deformable, tether web 94 to the bottom end portion of the skirt 50. In the preferred embodiment, there are two such tether webs 94 located about 180° apart. As can be seen in FIG. 20, each tether web 94 defines an internal recess 96. Each recess 96 is radially inwardly open, and each recess 96 extends axially so that is axially open at the bottom open end of the skirt 50.

In the preferred embodiment illustrated in FIGS. 1 and 8, the fitment 24 has two oppositely facing, 180° spaced-apart shear members 40, and the overcap skirt 50 has two sets of multiple-bridged apertures 74 divided by the frangible bridges 78 into smaller openings, and each of the two sets of apertures 74 and frangible bridges 78 is designed to interact with an associated one of the two shear members 40 as explained hereinafter.

As can be seen in FIGS. 1 and 20, the lower edge of the skirt 50 has a generally circular flange 100 having two oppositely facing planar surfaces 102 which are 180° apart. These may be used as keys or guides by the manufacturer to establish a desired orientation during conveyance and assembly of overcap 28 with the fitment 24.

Initially, the fitment 24 and the closure overcap 28 are preferably separately molded or otherwise provided as separate components. Subsequently, in a preferred process, the manufacturer assembles the two components together by effecting relative axial movement between the two components so as to force the spout 30 of the fitment 24 into the skirt 50 of the overcap 28. At least a portion of at least one of the components (typically the skirt 50 of the overcap 28), is sufficiently flexible and resilient to accommodate the insertion of the fitment spout 30 into the open end of the overcap skirt 50 in the initially assembled orientation (see FIGS. 1, 6, 7, and 8). In the initially assembled orientation, each shear member 40 is located so that it is received in, and projects through, the elongate opening portion 74A of one of the apertures 74. The assembly process is preferably effected without relative rotation between the overcap 28 and fitment 24. However, in an alternate assembly process, the two components could be threaded together and screwed into the initially assembled orientation.

The projecting shear members 40, in conjunction with the apertures 74 and 74A, can cause more desirable turbulence in a gas flow, such as during the sterilization of the closed closure assembly 20 by the packager prior to installation of the closure assembly 20 on a container (not illustrated). This can enhance the efficiency of the sterilization process.

After the assembly of the fitment 24 and overcap 28 in the initially assembled orientation (which is the initial, fully closed condition), if relative rotation is effected between the two components in an "unscrewing" or "opening" direction, then the fitment spout thread 34 does not initially engage the overcap skirt thread 70 in a manner that would effect axial movement of the overcap 28 during an initial amount of relative rotation between the fitment 24 and overcap 28. Rather, the fitment thread 34 and overcap thread 70 have a predetermined, identical pitch and are initially separated by a predetermined gap G1 (FIG. 6) so that initial rotation of the overcap 28 in the opening direction (indicated by arrow 108 in FIG. 8) relative to the fitment 24 will not initially cause an upward, axial movement of the overcap 28 owing to the gap G1 (FIG. 6). Such a thread arrangement and operation thereof are disclosed in the international patent application No. PCT/US2013/68209. In the particular form of the closure assembly illustrated, the thread 70 will not engage the upwardly facing camming surface of the fitment thread 34 until the overcap 28 has been rotated about 100° from the initially closed position illustrated in FIG. 6. Thus, the first approximately 100° of rotation of the overcap 28 relative to the fitment 24 does not immediately cause engagement of the overcap thread 70 with the fitment thread 34 in a way that would cause axial translation (i.e., axial movement) of the overcap 28.

Continued rotation of the overcap 28 away from the initially assembled orientation shown in FIGS. 1 and 6 will cause the gap G1 (FIG. 6) between the overcap thread 34 and the fitment thread 70 to begin to decrease to a smaller gap, and further rotation of the overcap 28 reduces the gap further until, after about 100° of rotation of the overcap 28 relative to the fitment 24, the gap G1 is zero. The arrangement of the threads 34 and 70 with an initial gap G1 between the threads can be designed in a conventional manner by one of ordinary skill in the art.

Figure 8:
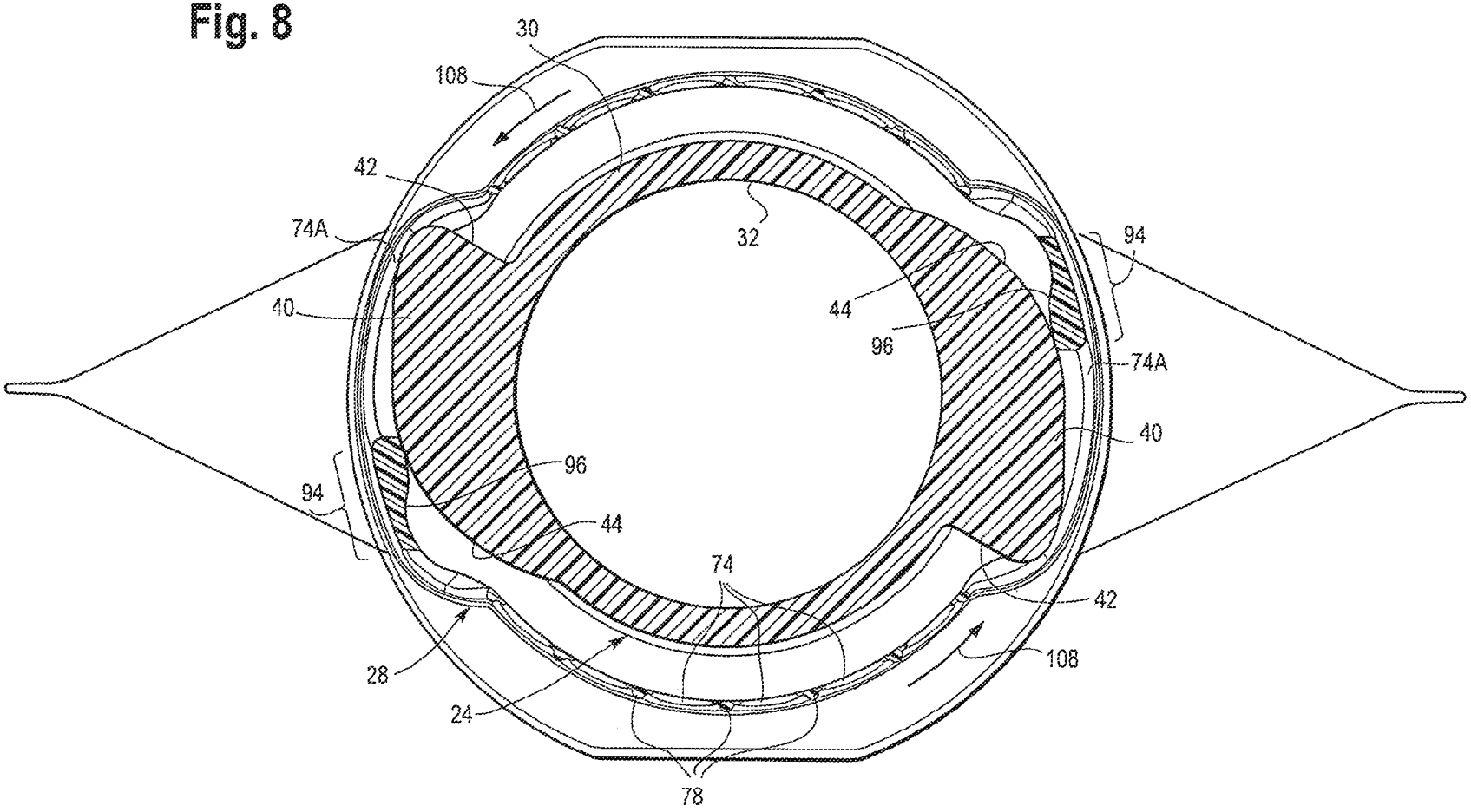
FIG. 8 is a cross-sectional view of the closure assembly taken along the plane 8-8 in FIG. 3.

In view of the initial thread arrangement with the gap G1 (FIG. 6), if a user attempts to open the overcap 28 by rotating the overcap 28 in the counterclockwise direction as indicated by the arrows 108 in FIG. 8, then the overcap 28 will initially rotate about the vertical axis, but will not initially also move axially outwardly up and along the fitment spout 30. The fitment thread 34 and overcap thread 70 are configured with the initial gap G1 so that they do not effect axial relative movement between the fitment 24 and overcap 28 until relative rotation has occurred over a predetermined angle of rotation (e.g., about 100°). Only after a sufficient amount of initial relative rotation do the threads 34 and 70 cooperate to cause the overcap 28 to move axially upwardly (outwardly) along the fitment spout 30.

The amount of rotation required before the overcap 28 is axially moved relative to the fitment 24 may be designed to be greater or smaller than 100°, depending on the particular designs of the skirt apertures 74 and various other features of the closure assembly 20.

In the initially assembled orientation illustrated in FIGS. 1 and 8, each shear member 40 projects outwardly into, and preferably partially through, one of the associated overcap skirt apertures 74—and in particular, partially through the elongate portion 74A of the aperture 74 which is initially divided by the plurality of frangible bridges 78. As the relative rotation is effected between the overcap 28 and the fitment 24, typically by a user grasping and rotating the overcap 28 in the counterclockwise direction indicated by the arrows 108 (FIG. 8), the frangible bridges 78 sequentially move against the leading edge 42 of the associated shear member 40 and are severed by the shear member 40.

As the user continues to rotate the overcap 28 in the counterclockwise direction as indicated by the arrows 108 in FIG. 8, the overcap thread 70 and the fitment thread 34 are initially not effective to cause axial movement of the overcap 28 until a predetermined amount of rotation has occurred (e.g., about 100°) as previously explained—thus the overcap 28 initially only rotates, but does not initially move axially upwardly relative to the fitment 24. The user continues rotating the overcap 28 so that the projecting shear members 40 each sequentially sever the associated frangible bridges 78. After the last frangible bridge 78 has been severed, the leading end 42 of each laterally projecting shear member 40 begins to engage the part of the tether web 94 between the last sheared frangible bridge 78/78A and the beginning of the elongate opening portion 74A of the other aperture 74. This engagement of the skirt tether webs 94 with the shear members 40 can cause the lower portion of the skirt 50 to deform radially outwardly (at least temporarily) in opposite directions (as described in the international patent application No. PCT/US2013/68209). This causes a radial distortion (which may be temporary or permanent) in the overcap lower portion of the skirt 50 (especially at the tether webs 94), and this radial distortion is readily apparent to the user as the user continues to rotate the overcap 28 in the opening direction (indicated by the rotational arrows 108 in FIG. 8).

In some applications, it may be desired that the radial distortion and deformation of the lower portion of the skirt 50 be only elastic and temporary. In other applications, it may be desired to provide a design in which at least some amount of the radial distortion and deformation of the overcap 28 is a permanent, inelastic deformation. While the permanent radial deformation and distortion of the lower part of the skirt 50 of the overcap 28 might be desirable in some applications, and while such permanent radial distortion could provide evidence of the opening of, or at last an attempt to open, the closure 20, it may not be necessary or desired in other applications.

During the opening process, as the overcap 28 is rotated (in the opening direction indicated by the arrows 108 in FIG. 8) and as the frangible bridges 78 are severed by the shear members 40, the severing of each frangible bridge 78 preferably generates an audible click. As the frangible bridges 78 are sequentially severed, the audible clicks may sound somewhat like the noise created when a conventional zipper is opened or closed. The user can tell from the sound that the frangible bridges 78 are being severed. Of course, the user can also visually observe the severing of the frangible bridges 78. Depending on the material from which the overcap 28 is molded, and depending on the particular thickness and/or shape of each frangible bridge 78, the sound generated by the severing of each frangible bridge 78 may be more or less audible to the user. Although the generation of a sound that is particularly audible to the user may be preferred in some applications, that may not be desirable or needed in other applications.

As the frangible bridges 78 are severed, whether or not a sound is heard by the user, the severing of each frangible bridge 78 may also provide a slight tactile feedback so that a relatively rapid rotation of the overcap 28 through a first angle of rotation (e.g., 100°) can result in a generally continuous vibratory feeling or feedback that is sensed by the user who is opening the closure. Such discernible tactile feedback, while preferred in some applications, may not be desirable or needed in other applications.

As each shear member 40 begins to engage, and outwardly deform, the lower portion of the skirt 50 of the overcap 28, the fitment thread 34 and the overcap thread 70 begin to contact in a camming engagement that exerts an axial force on the overcap 28 tending to urge the overcap 28 axially upwardly relative to the fitment 24. However, the overcap 28 is not initially free to move upwardly relative to the fitment 24 because a portion of each shear member 40 still lies within the associated aperture 74—thereby preventing upward movement of the portion of the skirt 50 below the apertures 74. Thus, the overcap skirt 50 becomes subject to axial tension and begins to elongate very slightly—preferably within the elastic range of the material.

Continued rotation of the overcap 28 tends to urge the overcap 28 axially upward while causing the overcap recesses 96 (FIGS. 8 and 20) to be moved adjacent the shear members 40, and each recess 96 in the deformed tether web 94 accommodates the largest radial dimension of each shear member 40. As can be seen in FIG. 11, each shear member 40 is laterally tapered so that it narrows toward its trailing end 44. The decreasing radial extent of each shear member 40 toward its trailing end 44 is such that, after sufficient rotation of the overcap 28 in the opening direction, each shear member 40 is no longer projecting into the overcap skirt aperture 74 and is no longer effective to positively resist the upward force being exerted by the lower portion of the skirt 50. When the shear members 40 no longer project into the skirt apertures 74, the overcap skirt 50, which has been elastically stretched in the axial direction, is now able to overcome any existing frictional engagement with the shear members 40, and can spring upwardly slightly, and this causes the lower edges of the skirt apertures 74 to move upwardly past each shear member 40.

In the illustrated embodiment, the action of a lower portion of the skirt 50 springing upwardly relative to each shear member 40 is preferably accompanied by a physical sensation that is felt by the user when the user rotates the overcap 28 to the open condition. The user may sense that the overcap 28 is "jumping up" or "popping up" or "snapping up" relative to the fitment 24. This sudden movement of the overcap 28 in the upward direction is preferred so as to provide the user with a further indication of the continuation of the opening process, but such a feature is not a required or essential feature.

As the user continues to rotate the overcap 28, each tether web 94 defining the recess 96 preferably remains outwardly distorted, but is not torn or severed. Thus, the lower portion of the skirt 50 below the apertures 74 remains tethered (attached) to the portion of the skirt 50 above the apertures 74 even though all of the frangible bridges 78 have been severed. Thus, the portion of the skirt 50 that has been radially outwardly deformed can now be pulled upwardly together with the rest of the overcap 28 by the action of the overcap thread 70 in camming engagement with the thread 34 of the fitment 24. And, upon further rotation of the overcap 28, the overcap 28 is moved axially (i.e., translated) further up and along the spout 30. Eventually, the threads 34 and 70 become disengaged, and the entire overcap 28 can be lifted upwardly off of the fitment 24 to open the closure assembly 20.

It will be noted that the trailing edge 44 of each shear member 40 is adapted for guiding the overcap skirt 50 as it rides up and around the shear members 40 during the relative axially upward movement of the overcap 28 as the overcap 28 is being rotated by the user.

Also, the trailing edge 44 of each shear member 40 can function to help guide the overcap 28 over the shear members 40 when the manufacturer initially installs the overcap 28 on the fitment 24.

The process for assembling the overcap 28 and the fitment 24 by the manufacturer could include the manufacturer merely pushing the overcap 28 down on the fitment 24 while both components are in proper rotational alignment for the initially assembled (closed) orientation (FIGS. 1 and 9), and the flexibility of the components, especially the flexibility of the overcap 28, would accommodate such an installation.

In another possible method of assembling the closure assembly 20, the overcap 28 could also be rotated as it is being pushed down on the fitment 24 so as to engage the fitment thread 34 with the overcap thread 70—with the rotation being terminated at the point when the azimuthal (i.e., rotational) alignment between the two components corresponds to the fully closed, initially assembled orientation.

It will also be appreciated that when the preferred embodiment of the overcap 28 is initially removed by the user from the fitment 24, the overcap frangible bridges 78 are severed, and the overcap lower end may remain (and preferably remains) radially distorted, but the overcap 28 also remains a unitary structure without any separate tear-off pieces or bands being generated by the opening process. As a result, there are no small, separate bits of the overcap 28 that could be a choking hazard for children or that would have to be separately recovered and retained for disposal. However, the structural and operational features of the preferred embodiment of the closure assembly 20 which prevent the formation of smaller, separate, discrete waste pieces are not an essential requirement of the broad aspects of the invention.

In some applications, it may be desirable to design the overcap 28 so that after the overcap 28 has been opened and removed from the fitment 24, there remains some small amount of outward radial distortion or deformation along the lower edge of the skirt 50 which defines a somewhat elongate or oval shape (as viewed in plan from above or below). In other applications, it may not be desired to have a permanent deformation, and it may instead be desirable to design the overcap skirt 50 so that it generally remains with an original, undeformed attractive shape.

The above-described operation of initially assembling, and subsequently opening, the tamper-evident closure assembly is also described in the international patent application No. PCT/US2013/68209.

It will be appreciated that according to the broad principles of one aspect of the present invention, the combination of the overcap 28 and fitment 24 can be designed to provide apertures and bridges to indicate that the overcap has been previously opened, or at least that an attempt was made to open the overcap—however, such features are not essential to other broad aspects of the invention.

It will be appreciated that the closure assembly 20 of the present invention need not necessarily include all of the features that have been so far described. For example, it will be appreciated that according to some general aspects of the present invention relating to the closure assembly overcap/fitment sealing configurations, the number and shape of the frangible bridges 78, and the apertures 74, including openings defined between the frangible bridges 78, can be varied, or the tamper-evident features (e.g., bridges 78, apertures 74, and shear members 40) can be omitted altogether.

The closure assembly 20 described herein includes the following two main concepts, concept 1 and concept 2, that may be provided in combination with each other or may be provided independently of each other in a closure assembly without the other concept:

Concept 1—the combination of a) at least an outer seal established by engagement of the fitment (e.g., the sealing surfaces 45A, 45B) with the overcap (e.g., sealing surfaces 63A, 63B), and b) the structure of the fitment spout shear members 40 and overcap apertures 74 that increase turbulence in a cleaning gas flow stream (e.g., hydrogen peroxide gas in a sterilization chamber) to enhance the cleaning and/or efficiency of the cleaning process; and Concept 2—the configuration and combination of first and second seals established by the fitment 24 and overcap 28—namely a) the fitment sealing surface 47A engaging the sealing surface 58A on the elongate hollow plug 58 of the overcap 28 to establish a deeply recessed, inner, first seal in the closure assembly 20; and b) the fitment sealing surfaces 45A, 45B engaging the overcap sealing surfaces 63A, 63B, respectively, to establish an outer, second seal in the closure assembly 20.

The present invention can be more particularly summarized in the following statements or aspects numbered 1-17:

1. A combination of a overcap and a fitment for a container, which together in an initially assembled orientation prevent, but can be subsequently operated to permit, communication through the fitment, said combination comprising:

said fitment having a spout defining (A) an access passage, (B) an exterior sealing surface, and (C) at least one laterally projecting shear member; and said overcap defining (A) a skirt extending over a portion of said spout, said skirt having a skirt sealing surface for engaging said fitment exterior sealing surface to create a seal when said overcap and said fitment are in said initially assembled orientation, (B) an aperture for initially receiving said shear member when said overcap and fitment are in said initially assembled orientation, and (C) at least one frangible bridge extending across a portion of said aperture for being severed by said shear member during relative rotation between said overcap and fitment, wherein said aperture and said shear member cooperate when said overcap and said fitment are in said initially assembled orientation and subjected to a flow of a sterilizing gas to create turbulence in said sterilizing gas flow adjacent portions of said overcap and said fitment to enhance sterilization thereof.

2. The combination in accordance with aspect 1 in which said aperture and said at least one frangible bridge are located axially inward of said seal.

3. The combination in accordance with any of the preceding aspects in which said shear member projects laterally outwardly through said aperture beyond the radial extent of said at least one frangible bridge when said fitment and said overcap are in said initially assembled orientation.

4. The combination in accordance with any of the preceding aspects in which said at least one frangible bridge has oppositely facing sides that each have a concave configuration.

5. The combination in accordance with any of the preceding aspects in which said fitment includes two of said shear members diametrically opposed to each other, and said overcap defines two sets of a plurality of said frangible bridges wherein said two sets of said plurality of said frangible bridges are diametrically opposed to each other and wherein each set of said plurality of said frangible bridges is respectively engageable by one of said shear members.

6. The combination in accordance with any of the preceding aspects in which said overcap defines a plurality of said frangible bridges arranged in a spaced-apart configuration for being sequentially severed by said shear member;

at least some of said frangible bridges each have a transverse cross-section that includes a radially outwardly bulging configuration for being impinged by a sterilizing gas.

7. A combination of a overcap and a fitment for a container, which together in an initially assembled orientation prevent, but can be subsequently operated to permit, communication through the fitment, said combination comprising:

said fitment having a spout defining (A) an access passage, (B) an interior sealing surface, and (C) an exterior sealing surface; and said overcap having (A) a top deck from which extends an elongate, hollow plug, said elongate, hollow plug having a plug sealing surface for engaging said fitment interior sealing surface to create a first seal when said overcap and said fitment are in said initially assembled orientation, (B) a skirt extending over at least a portion of said spout and having a skirt sealing surface for engaging said fitment exterior sealing surface to create a second seal when said overcap and said fitment are in said initially assembled orientation, and (C) an annular channel defined between said elongate, hollow plug and said skirt into which said fitment spout extends to accommodate relative rotation between said overcap and said fitment.

8. The combination in accordance with aspect 7 in which said spout defines one of a cam and cam follower; and said skirt defines the other of said cam and said cam follower for engaging said one of said cam and cam follower on said spout to effect relative axial movement between said fitment and said overcap.

9. The combination in accordance with aspect 8 in which said cam and cam follower are located between said first and second seals.

10. The combination in accordance with any of the preceding aspects 7-9 in which said first seal is located axially inward of said second seal.

11. The combination in accordance with any of the preceding aspects 7-10 in which said plug sealing surface is frustoconical, and said fitment interior sealing surface are generally cylindrical, whereby said first seal is annular.

12. The combination in accordance with any of the preceding aspects 7-11 in which said fitment exterior sealing surface has the form of a shoulder defining (1) a cylindrical first portion, and (2) an annular second portion; and said skirt sealing surface has (1) a cylindrical first portion to engage said fitment exterior sealing surface cylindrical first portion, and (2) an annular second portion to engage said fitment exterior sealing surface annular second portion.

13. The combination in accordance with any of the preceding aspects 7-12 in which said spout interior sealing surface is defined by an annular projection extending laterally inwardly into said access passage.

14. The combination in accordance with any of the preceding aspects 7-13 in which said fitment further comprises a body that can be sealed to a flexible pouch and that has a base outer end from which said spout projects;

said spout has an outer end defining a rim around said access passage;

said first seal is axially spaced a first distance D1 from said base outer end;

said rim is axially spaced a second distance D2 from said base outer end; and said first distance D1 is less than half of said second distance D2.

15. The combination in accordance with any of the preceding aspects 7-14 in which said spout has an outer end defining a rim that is axially spaced from said overcap top deck when said overcap and said fitment are in said initially assembled orientation.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A combination of a overcap and a fitment for a container, which together in an initially assembled orientation prevent, but can be subsequently operated to permit, communication through the fitment, said combination comprising:

said fitment having a spout defining (A) an access passage, (B) an exterior sealing surface, and (C) at least one laterally projecting shear member; and said overcap defining (A) a skirt extending over a portion of said spout, said skirt having a skirt sealing surface for engaging said fitment exterior sealing surface to create a seal when said overcap and said fitment are in said initially assembled orientation, (B) an aperture for initially receiving said shear member when said overcap and fitment are in said initially assembled orientation, and (C) at least one frangible bridge extending across a portion of said aperture for being severed by said shear member during relative rotation between said overcap and fitment, wherein said aperture and said shear member cooperate when said overcap and said fitment are in said initially assembled orientation and subjected to a flow of a sterilizing gas to create turbulence in said sterilizing gas flow adjacent portions of said overcap and said fitment to enhance sterilization thereof, said at least one frangible bridge has oppositely facing sides that each have a concave configuration.

2. A combination of a overcap and a fitment for a container, which together in an initially assembled orientation prevent, but can be subsequently operated to permit, communication through the fitment, said combination comprising:

said fitment having a spout defining (A) an access passage, (B) an exterior sealing surface, and (C) at least one laterally projecting shear member; and said overcap defining (A) a skirt extending over a portion of said spout, said skirt having a skirt sealing surface for engaging said fitment exterior sealing surface to create a seal when said overcap and said fitment are in said initially assembled orientation, (B) an aperture for initially receiving said shear member when said overcap and fitment are in said initially assembled orientation, and (C) at least one frangible bridge extending across a portion of said aperture for being severed by said shear member during relative rotation between said overcap and fitment, wherein said aperture and said shear member cooperate when said overcap and said fitment are in said initially assembled orientation and subjected to a flow of a sterilizing gas to create turbulence in said sterilizing gas flow adjacent portions of said overcap and said fitment to enhance sterilization thereof, said overcap defines a plurality of said frangible bridges arranged in a spaced-apart configuration for being sequentially severed by said shear member;

at least some of said frangible bridges each have a transverse cross-section that includes a radially outwardly bulging configuration for being impinged by a sterilizing gas.

3. A combination of a overcap and a fitment for a container, which together in an initially assembled orientation prevent, but can be subsequently operated to permit, communication through the fitment, said combination comprising:

said fitment having a spout defining (A) an access passage, (B) an interior sealing surface, and (C) an exterior sealing surface; and said overcap having (A) a top deck from which extends an elongate, hollow plug, said elongate, hollow plug having a plug sealing surface for engaging said fitment interior sealing surface to create a first seal when said overcap and said fitment are in said initially assembled orientation, (B) a skirt extending over at least a portion of said spout and having a skirt sealing surface for engaging said fitment exterior sealing surface to create a second seal when said overcap and said fitment are in said initially assembled orientation, and (C) an annular channel defined between said elongate, hollow plug and said skirt into which said fitment spout extends to accommodate relative rotation between said overcap and said fitment, said spout defines one of a cam and cam follower; and said skirt defines the other of said cam and said cam follower for engaging said one of said cam and cam follower on said spout to effect relative axial movement between said fitment and said overcap, said cam and cam follower are located between said first and second seals.

* * * * *